US006405626B1

(12) United States Patent
Bureaux et al.

(10) Patent No.: US 6,405,626 B1
(45) Date of Patent: Jun. 18, 2002

(54) DECONTAMINATING AND DISPERSION SUPPRESSING FOAM FORMULATION

(75) Inventors: John G. Bureaux; George R. Cowan; N. Edward Cundasawmy, all of Ontario; J. Garfield Purdon, Alberta, all of (CA)

(73) Assignee: Her Majesty the Queen in right of Canada as represented by the Solicitor General Acting through the Commissioner of the Royal Canadian Mounted Police, Ottawa (CA)

( * ) Notice: Subject to any disclaimer, the term of this patent is extended or adjusted under 35 U.S.C. 154(b) by 0 days.

(21) Appl. No.: 09/513,189

(22) Filed: Feb. 25, 2000

Related U.S. Application Data

(60) Provisional application No. 60/122,091, filed on Feb. 26, 1999.

(51) Int. Cl.[7] ..... F42B 33/00
(52) U.S. Cl. ..... 86/50

(58) Field of Search ..... 86/50

(56) References Cited

U.S. PATENT DOCUMENTS

| | | | | |
|---|---|---|---|---|
| 4,543,872 A | * | 10/1985 | Graham et al. | 86/50 |
| 4,589,341 A | * | 5/1986 | Clark et al. | 102/303 |
| 5,864,767 A | * | 1/1999 | Drumgoole et al. | 588/202 |

FOREIGN PATENT DOCUMENTS

| | | |
|---|---|---|
| CA | 1104028 | 6/1981 |
| EP | 0526305 A | 2/1993 |
| JP | 11-148098 | 6/1999 |
| WO | WO 98/30861 | 7/1998 |

OTHER PUBLICATIONS

JP 52 071592 (Mitsubishichem Ind Ltd) Database WPI, Section Ch, Week 197730, Derwent Publications Ltd., London, GB; AN 1977–53259Y, XP002134423.
KR9 309 035 B (Res Inst Nat Defence) Database WPI, Section Ch, Week 199436, Derwent Publications Ltd., London, GB; An 1994–291518, XP002134427, Sep. 22, 1993.
Patent Abstracts of Japan, vol. 006, No. 019 (C–090), Feb. 3, 1982 & JP 56 143226 A (KAO Corp), Nov. 7, 1981.
Database WPI, Section Ch., Week 198151, Derwent Publications Ltd., London, GB; AN 1981–93944D, XP002134424 & JP 56 143300 A(KAO Soap Co Ltd), Nov. 7, 1981.
International Search Report in PCT/CA00/00199 dated Oct. 7, 2000.

* cited by examiner

*Primary Examiner*—Charles T. Jordan
*Assistant Examiner*—Francis T. Palo
(74) *Attorney, Agent, or Firm*—Nixon & Vanderhye P.C.

(57) ABSTRACT

A method and foam formulation are provided for enabling both blast suppressing and decontamination, particularly desirable when faced with an explosive device which has been rigged with a contaminant for destructive dissemination. A formulation is foamed to surround the explosive CB contaminant device, preferably encapsulated in a containment structure. The preferred composition of foamer-compatible decontaminant and foamer to foam and surround the device is about 1% to 3%/w of hydrated chloroisocyanuric acid salts and more including lithium hypochlorite, about 1% of a co-solvent selected from the group consisting of polypropylene glycols, polyethylene glycols, and derivatives and mixtures thereof; about 1% to about 5% of a surfactant and foam stabilizer; and a buffer system to initially maintain said formulation at a pH from about 11.0 to about 8.5 for a minimum of 30 minutes; and the balance being water.

20 Claims, 30 Drawing Sheets

Range DAAMS Tube Sampler Setup

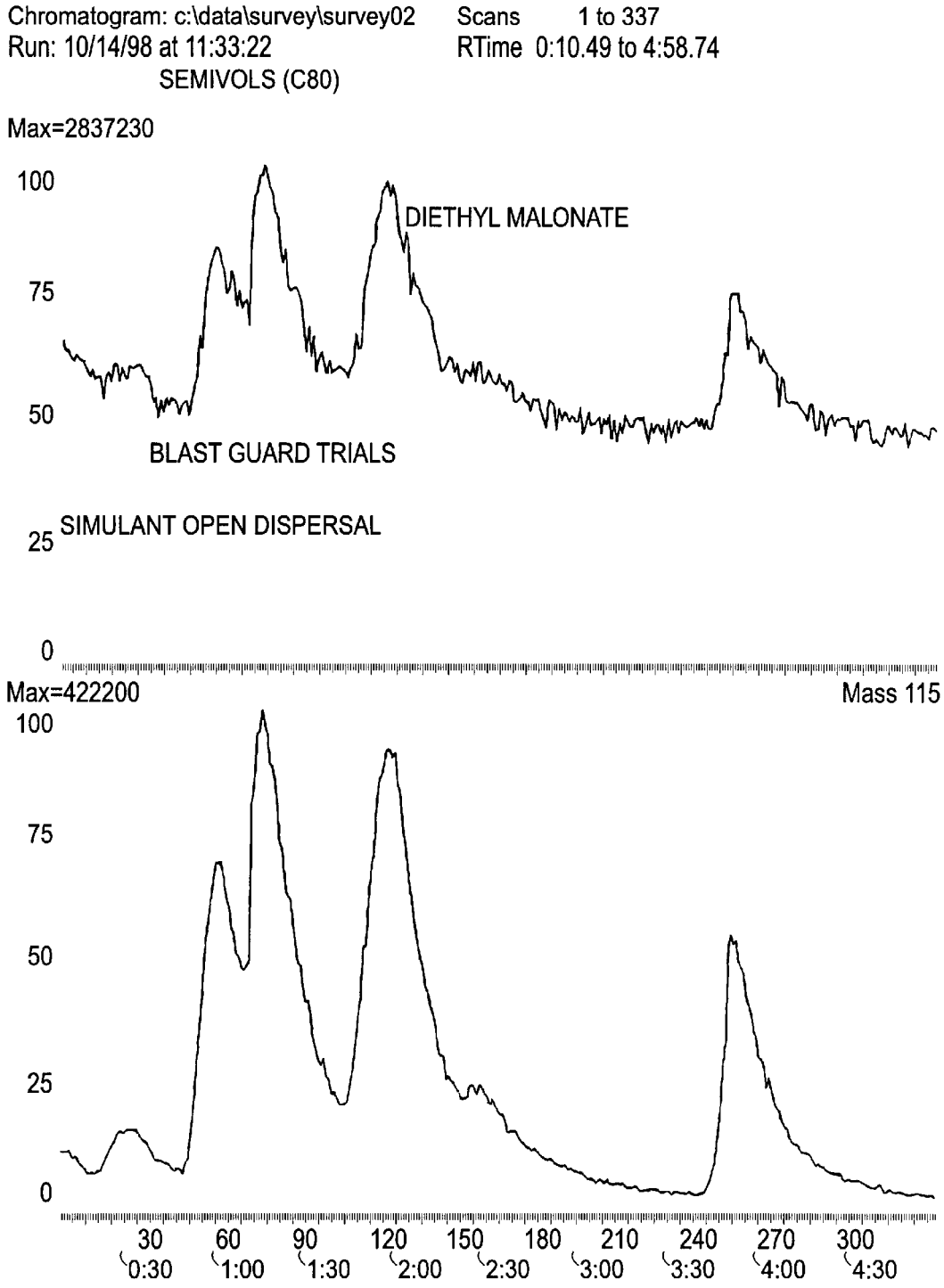
*Fig. 12* Hapsite Survey of DEM Simulant Layout after Explosive Dispersal

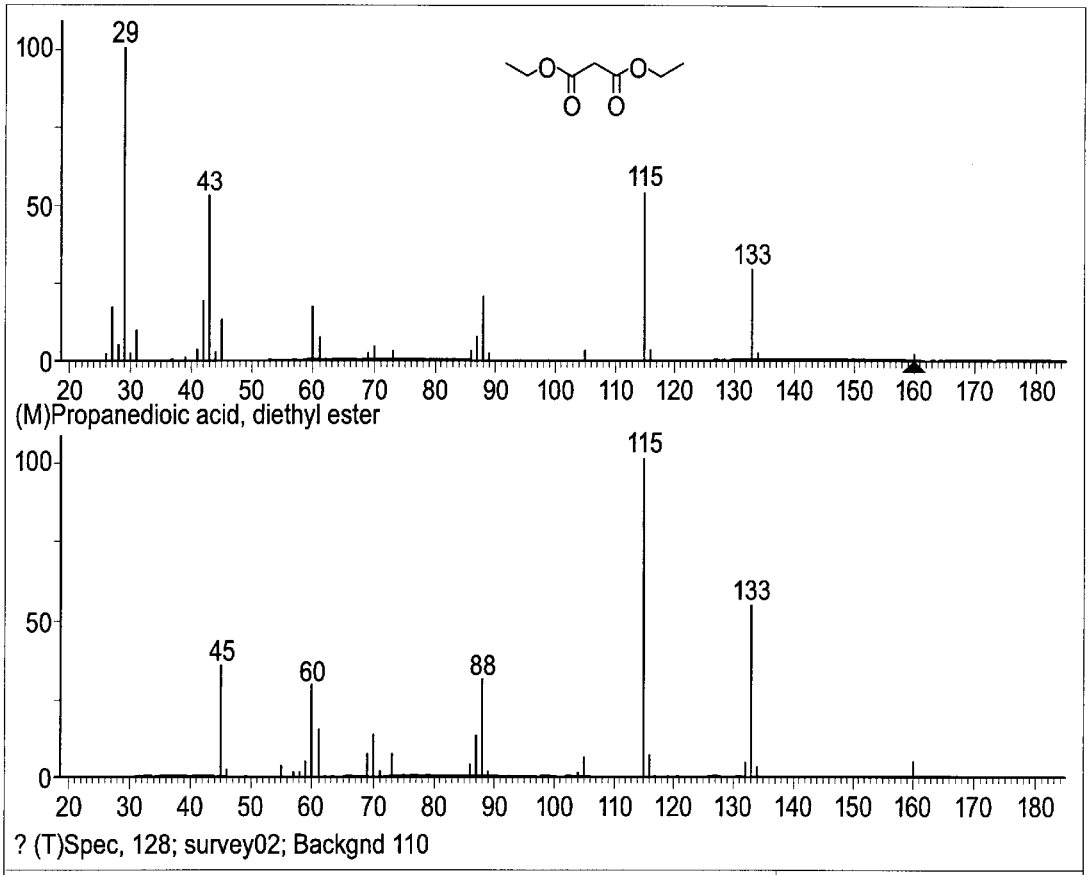

| | | | | | |
|---|---|---|---|---|---|
| 1 | 859 | 880R | 97.5P | (M)Propanedioic acid, diethyl ester | 1 ? (T) Spec. 128, survey02: |
| 2 | 632 | 675R | 0.97P | (M)Butanedioic acid, methyl-, bis(1-methylpropyl) est | |
| 3 | 627 | 652R | 0.78P | (M)t-Butyl ethyl malonate | |
| 4 | 611 | 642R | 0.47P | (M)Propanedioic acid, ethyl-, bis(1-methylpropyl) est | |
| 5 | 560 | 571R | 0.10P | (M)Triethyl methanetricarboxylate | |
| 6 | 553 | 589R | 0.08P | (M)Propanedioic acid, dimethyl-, bis(1-methylpropyl) | |
| 7 | 538 | 549R | 0.04P | (M)Diethyl tert-butylmalonate | |
| 8 | 504 | 544R | 0.01P | (M)Ethylmalonic acid dibutyl ester | |
| 9 | 499 | 708R | 0.01P | (M)Methyl 3-((methylsulphonyl)acetyl)propanoate | |
| 10 | 499 | 515R | 0.00P | (M)Pentanedioic acid, bis(1-methylpropyl) ester | |
| 11 | 497 | 523R | 0.00P | (M)Propane, 1-nitro-2-(2-propenylthio)- | |
| 12 | 496 | 517R | 0.00P | (M)Diethyl sec-butylmalonate | |
| 13 | 486 | 535R | 0.00P | (M)Lyxopyranose, 2,3,4-tri-O-methyl-1-O-(trimethylsi) | |
| 14 | 484 | 730R | 0.00P | (M)2,4-Hexadienedioic acid, 2-fluoro- | |

*Fig. 13* Mass Spectral Analysis Results - Simulant Dispersal Trial

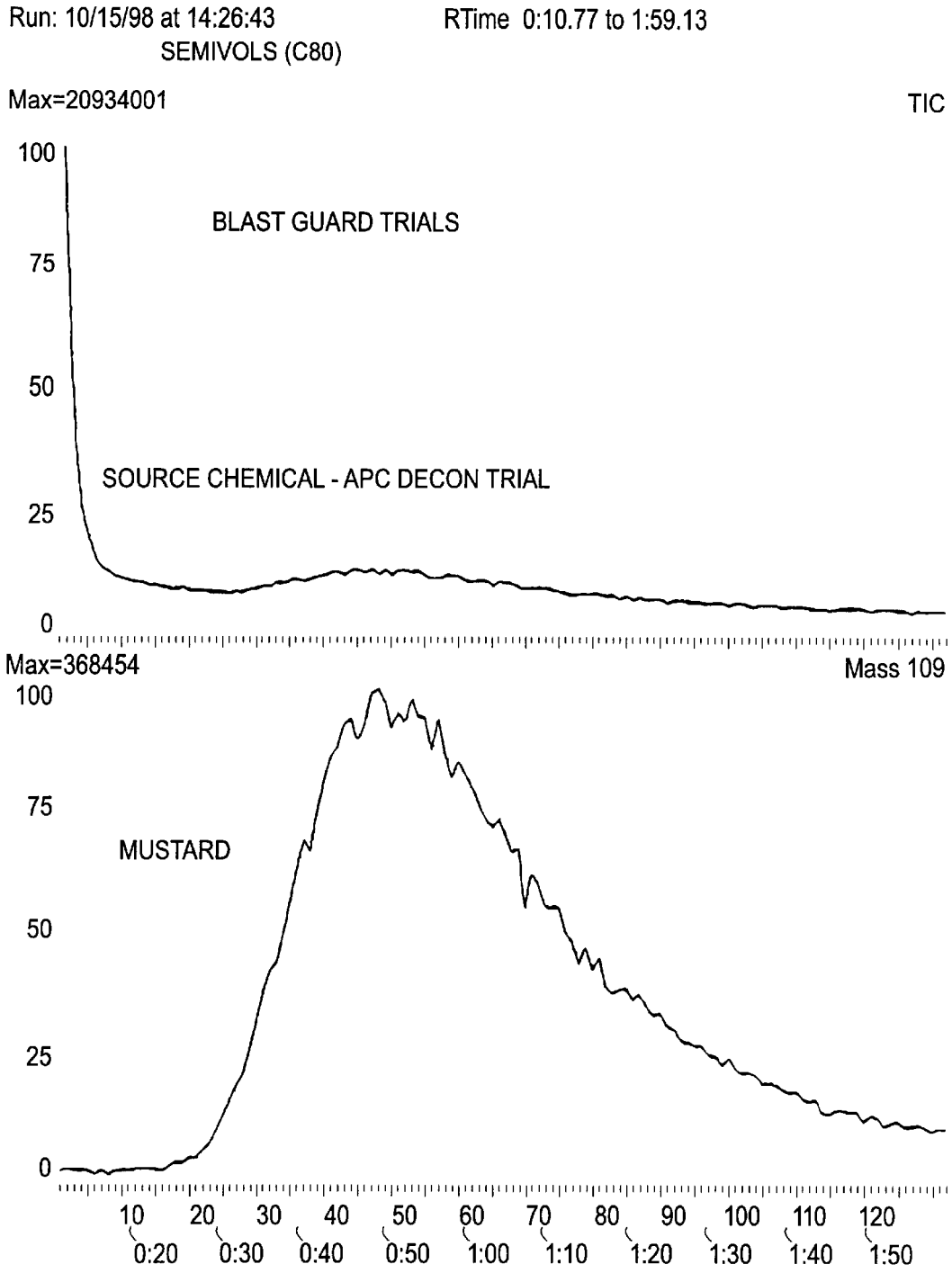
*Fig. 14* Air Sample Collected Near Vehicle Contaminated with Mustard Agent

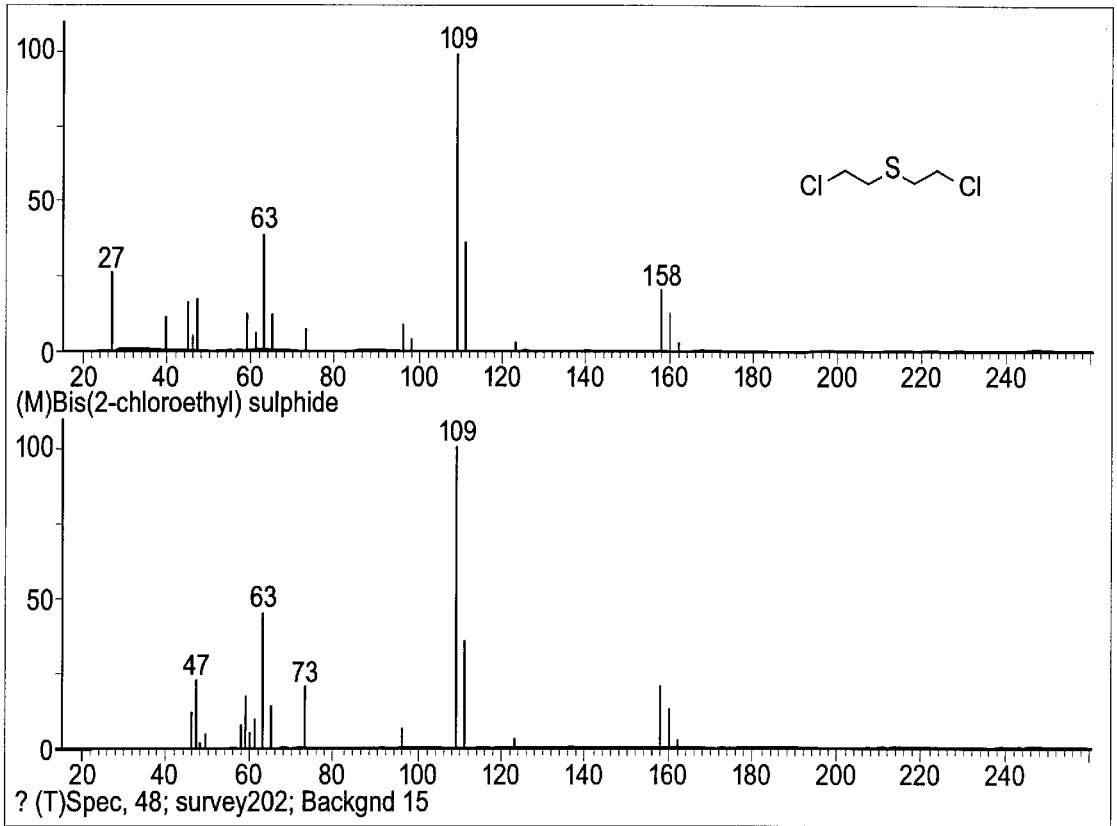

| | | | | | |
|---|---|---|---|---|---|
| 1 | 878 | 909R | 98.7P | (M)Bis(2-chloroethyl) sulphide | 1 ? (T) Spec, 48; survey202; |
| 2 | 566 | 675R | 0.98P | (M)5-Chloro-2, 4-dithiahexane 2,2-dioxide | 2 (T) Spec, 48; survey202; Ba |
| 3 | 501 | 588R | 0.15P | (M)1-Propene, 3,3,3-trichloro- | 3 (T) Spec, 48; survey202; Ba |
| 4 | 477 | 494R | 0.09P | (M)Butane, 1,2,3,4-tetrachloro- | 4 (T) Spec, 48; survey202; Ba |
| 5 | 446 | 558R | 0.02P | (M)1-Propene, 1,2,3-trichloro- | 5 (T) Spec, 49; survey202; Ba |
| 6 | 444 | 572R | 0.02P | (M)1-Propene, 1,1,3-trichloro- | 6 (T) Spec, 48; survey202; Ba |
| 7 | 444 | 514R | 0.01P | (M)Cyclopropane, 1,1-dichloro-2-(methylthio)- | |
| 8 | 438 | 443R | 0.01P | (M)Butane, 1,2,2,4-tetrachloro- | |
| 9 | 407 | 463R | 0.00P | (M)1-Pentene, 1,1,5-trichloro- | |
| 10 | 370 | 580R | 0.00P | (M)Alanine, N-isopropyl-3-(isopropylthio)-, isopropyl | |
| 11 | 367 | 451R | 0.00P | (M)Propane, 1,1,1,3-tetrachloro- | |
| 12 | 364 | 458R | 0.00P | (M)Benzene, (fluoromethyl)- | |
| 13 | 363 | 409R | 0.00P | (M)1,2-Ethanediol dimethanesulphonate | |
| 14 | 362 | 367R | 0.00P | (M)1-Propene, 3,3,3-trichloro-2-methyl- | |

*Fig. 15* Mass Spectral Identification of Mustard as Agent Used During Vehicle Decontamination Trials

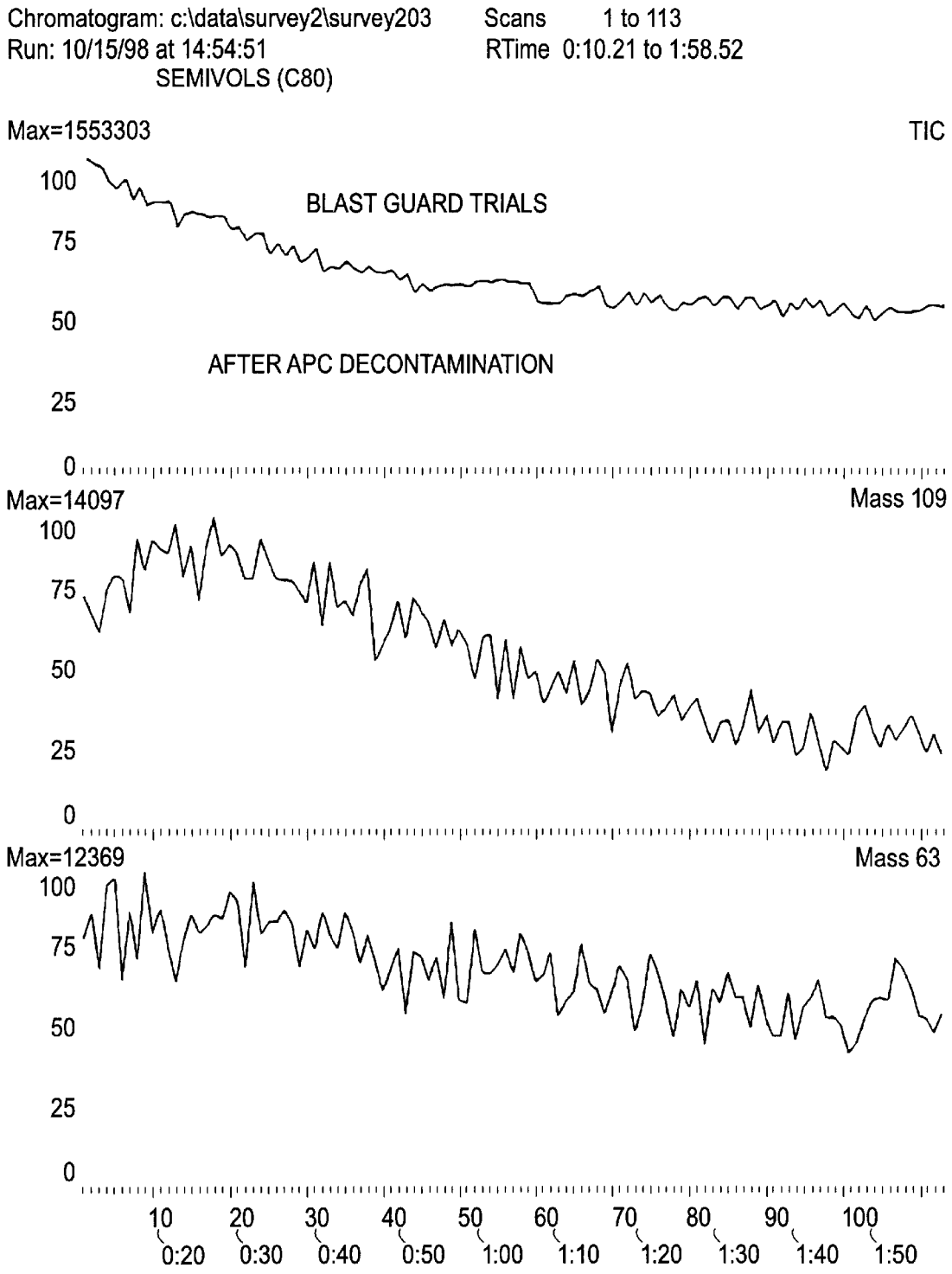
*Fig. 16* Air Sample Acquired after Vehicle Decontamination Showing Absence of Mustard Agent Vapour

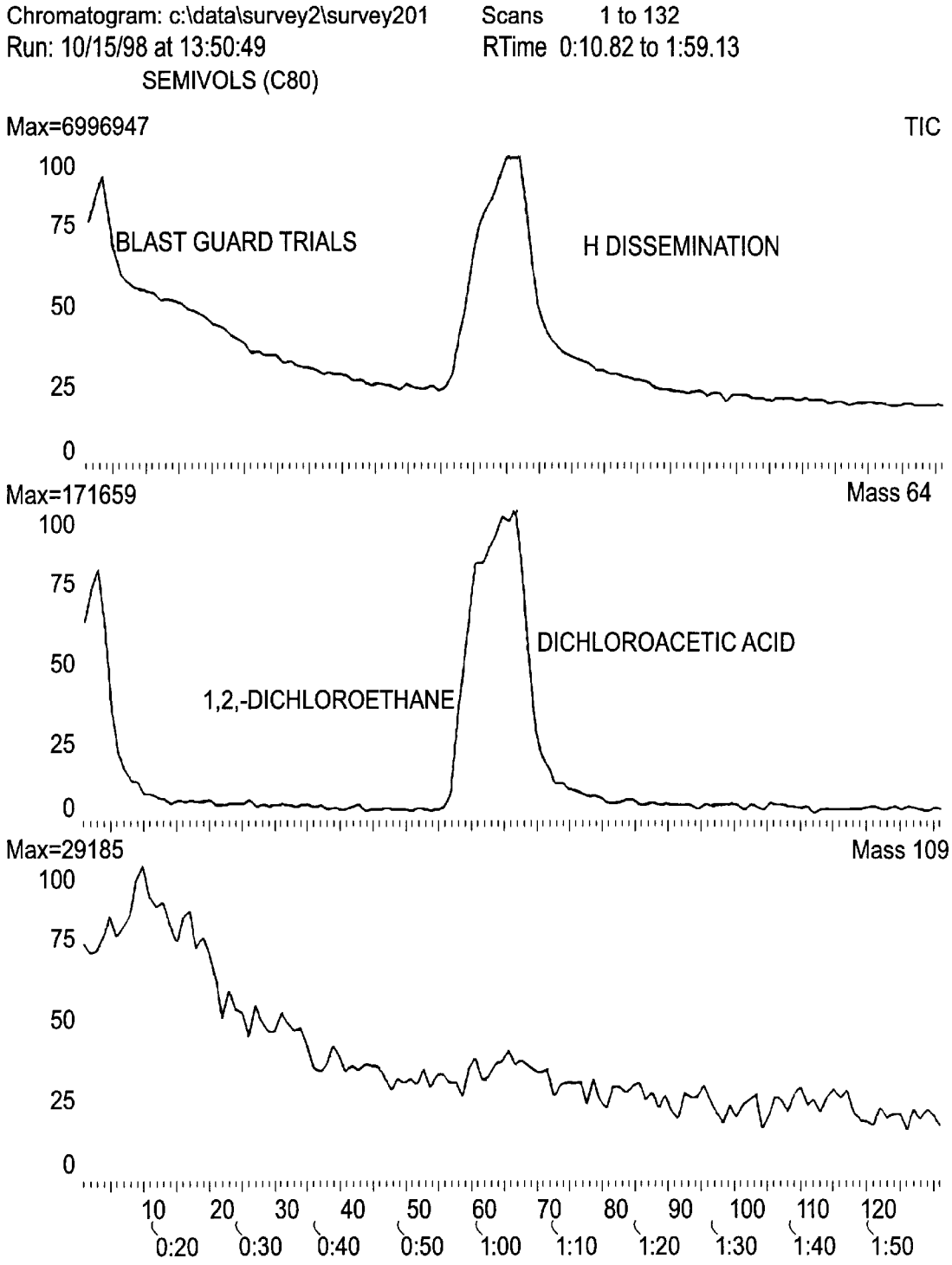
*Fig. 17* Hapsite Survey of Tent Head Space Air after Mustard Agent Dispersal

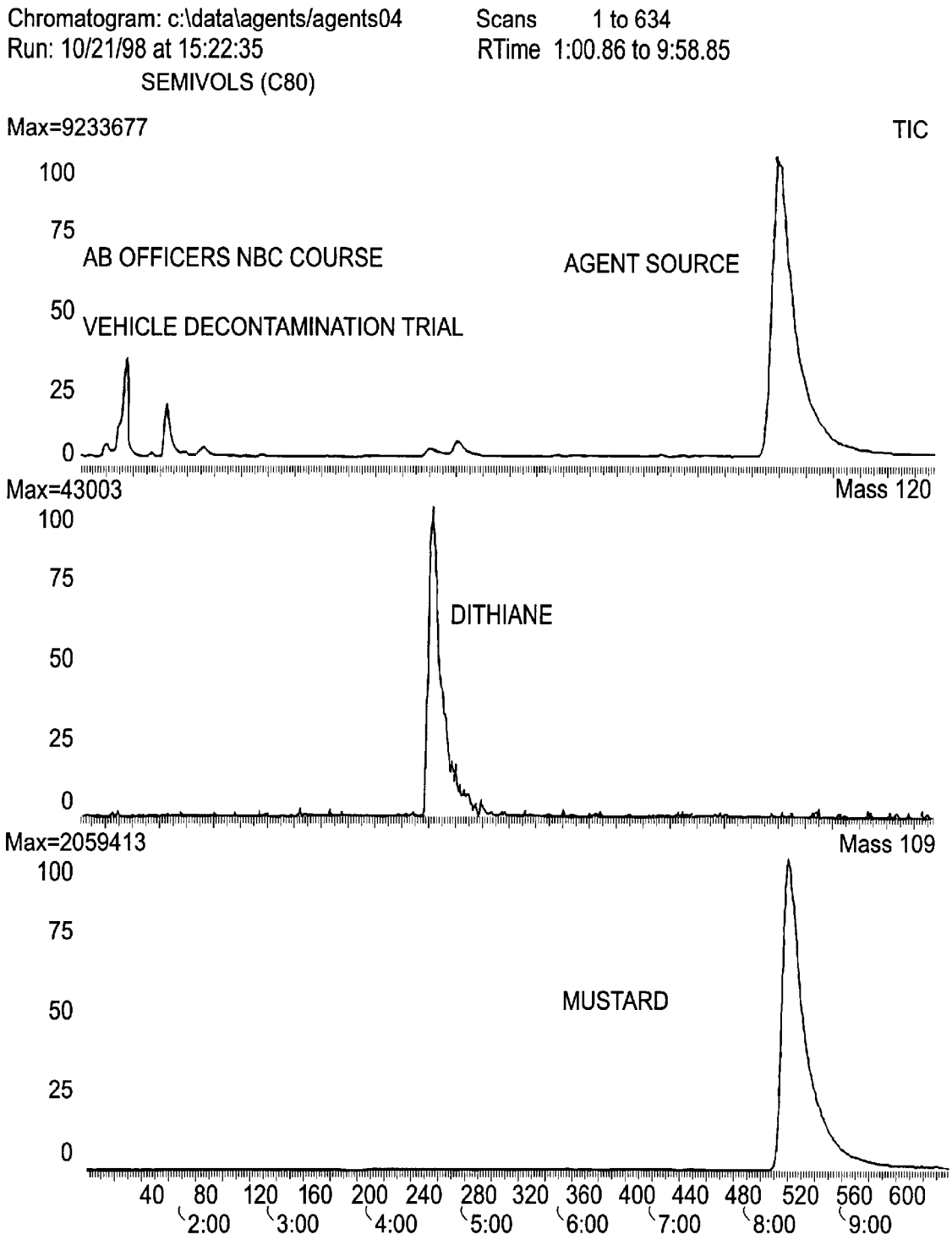
*Fig. 18a* Analysis of Vapour from Agent Used in DRES NBC Training Exercises

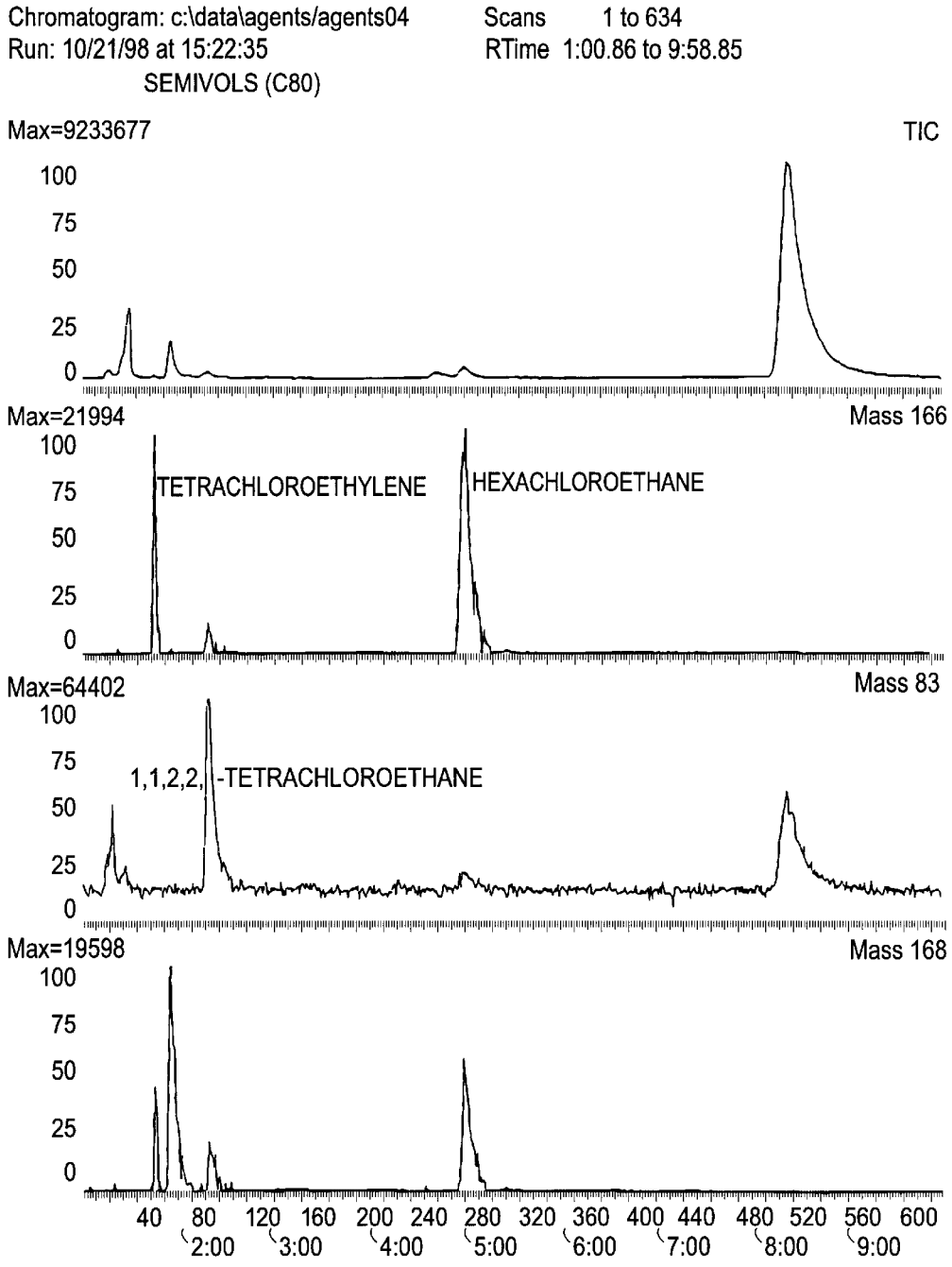
*Fig. 18b* Analysis of Mustard Agent Vapour Showing Additional Solvent Components

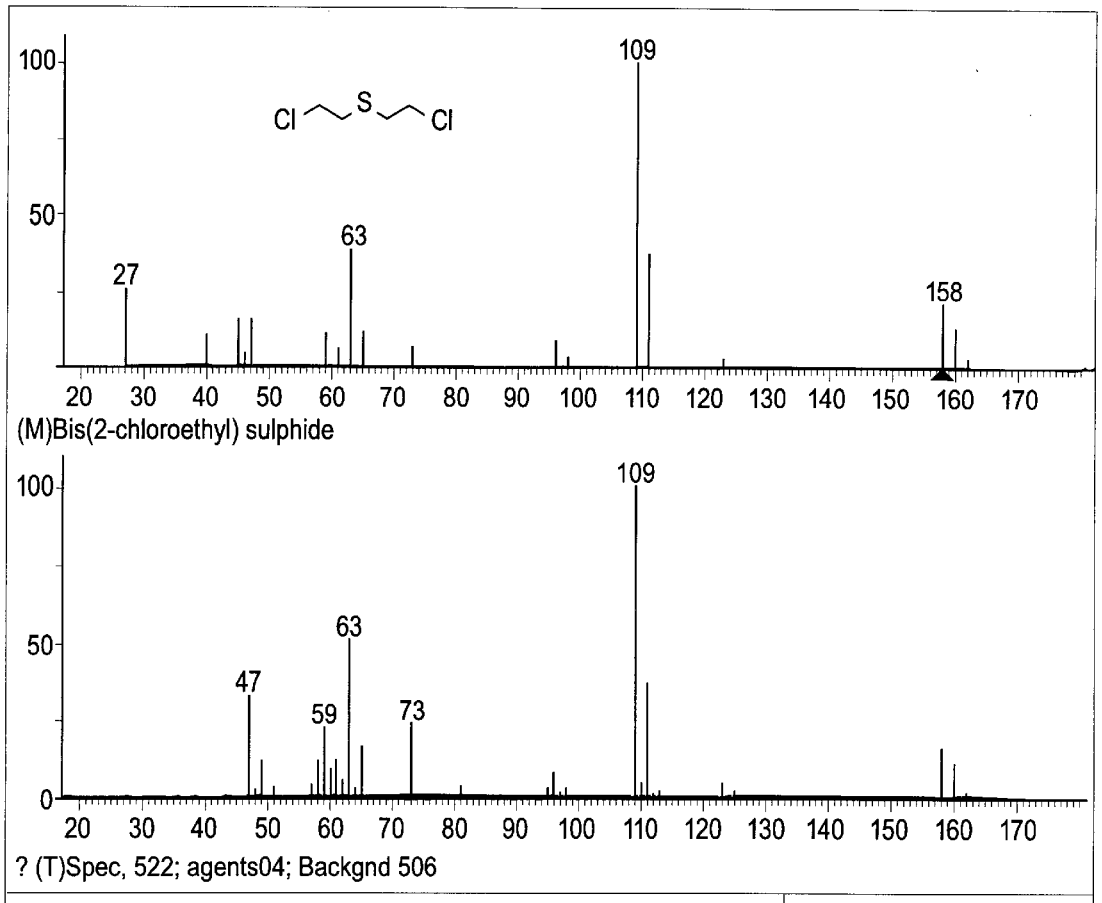

| | | | | |
|---|---|---|---|---|
| 1 | 838 | 954R | 97.4P | (M)Bix(2-cholorethyl) sulphide |
| 2 | 564 | 632R | 0.97P | (M)1-Propene, 3,3,3-tricholoro- |
| 3 | 559 | 585R | 0.78P | (M)Butane, 1,2,3,4-tetrachloro- |
| 4 | 518 | 767R | 0.19P | (M)1-Propene, 1,1,3-trichloro- |
| 5 | 518 | 699R | 0.15P | (M)5-Chloro-2,4-dithiahexane 2,2-dioxide |
| 6 | 518 | 517R | 0.12P | (M)Butane, 1,2,2,4-tetrachloro- |
| 7 | 489 | 553R | 0.07P | (M)1-Pentene, 1,1,5-trichloro- |
| 8 | 486 | 592R | 0.05P | (M)1-Propene, 1,2,3-trichloro- |
| 9 | 473 | 530R | 0.05P | (M)p-Fluoroethylbenzene |
| 10 | 452 | 533R | 0.03P | (M)Benzene, (fluoromethyl)- |
| 11 | 449 | 583R | 0.02P | (M)1,1-Dimethyl-1-silacyclo-2,4-hexadiene |
| 12 | 448 | 560R | 0.01P | (M)Cyclopropane, 1,1-dichloro-2-(methylthio)- |
| 13 | 447 | 488R | 0.01P | (M)Propanoic acid, 3-chloro-, ethyl ester |
| 14 | 446 | 492R | 0.01P | (M)Acetic acid, (4-hydroxyphenoxy)- |

| | |
|---|---|
| 1 | (T) Spec, 128; survey02; B |
| 2 | (T) Spec, 597; agents05; B |
| 3 | (T) Spec, 268; agents02; B |
| 4 | (T) Spec, 522; agents04; B |
| 5 | (T) Spec, 262; agents04; B |
| 6 | (T) Spec, 128; survey02; B |
| 7 | (T) Spec, 597; agents05; B |
| 8 | (T) Spec, 268; agents02; B |
| 9 | ?(T) Spec, 522; agents04; |
| 10 | (T) Spec, 128; survey02; B |
| 11 | (T) Spec, 597; agents05; B |
| 12 | (T) Spec, 268; agents02; B |

*Fig. 19a* Mass Spectral Identification of Source Agent Vapour - Mustard

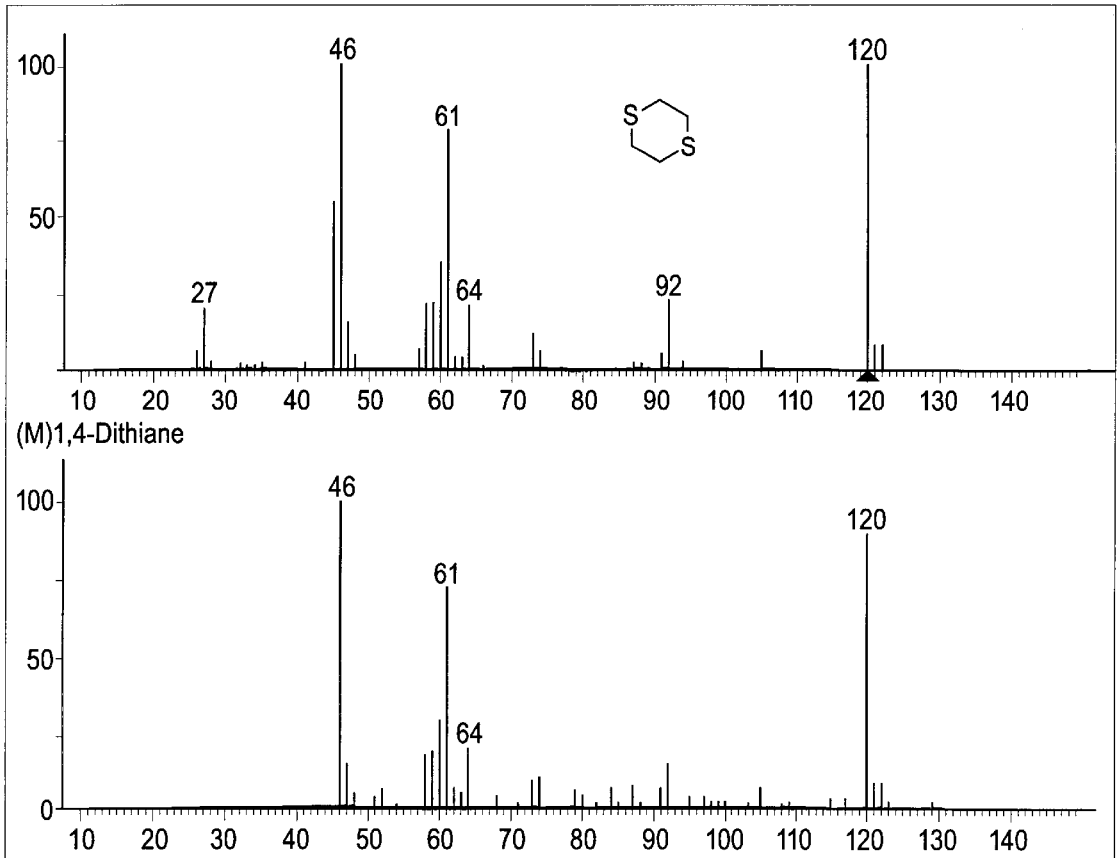

? (T)Spec, 262: agents04; backgnd 251

| | | | | |
|---|---|---|---|---|
| 1 | 794 | 882R | 91.3P | (M)1,4-Dithiane |
| 2 | 677 | 737R | 5.47P | (M)1,3-Dithiane |
| 3 | 628 | 677R | 1.16P | (M)Ethene, 1,2-bis(methylthio)- |
| 4 | 611 | 720R | 0.70P | (M)Propanoic acid, 3-(methylthio)- |
| 5 | 608 | 783R | 0.57P | (M)Benzoic acid, 2-hydroxy-, phenyl ester, ion(1-) |
| 6 | 579 | 683R | 0.17P | (M)Acetic acid, (ethylthio)- |
| 7 | 578 | 711R | 0.14P | (M)Propanoic acid, 2-mercapto-, methyl ester |
| 8 | 569 | 870R | 0.11P | (M)Propanoic acid, 3-mercapto-, methyl ester |
| 9 | 557 | 778R | 0.09P | (M)2-Methyl-1,3-dithiacyclopentane |
| 10 | 534 | 565R | 0.05P | (M)Ethanol, 2,2'-[1,2-ethanedlylbis(thio)]bis- |
| 11 | 532 | 656R | 0.04P | (M)Silanol, trimethyl-, nitrate |
| 12 | 509 | 609R | 0.02P | (M)2-(Propylthio)ethanol |
| 13 | 508 | 692R | 0.02P | (M)Aminohippuric Acid |
| 14 | 508 | 530R | 0.01P | (M)Ethanethiol, 2,2'-thiobis- |

| | |
|---|---|
| 1 | (T) Spec, 128; survey02; B |
| 2 | (T) Spec, 597; agents05; B |
| 3 | (T) Spec, 268; agents02; B |
| 4 | (T) Spec, 522; agents04; B |
| 5 | ?(T) Spec, 262; agents04; |
| 6 | (T) Spec, 128; survey02; B |
| 7 | (T) Spec, 597; agents05; B |
| 8 | (T) Spec, 268; agents02; B |
| 9 | (T) Spec, 522; agents04; B |
| 10 | (T) Spec, 128; survey02; B |
| 11 | (T) Spec, 597; agents05; B |
| 12 | (T) Spec, 288; agents02; B |

*Fig. 19b*

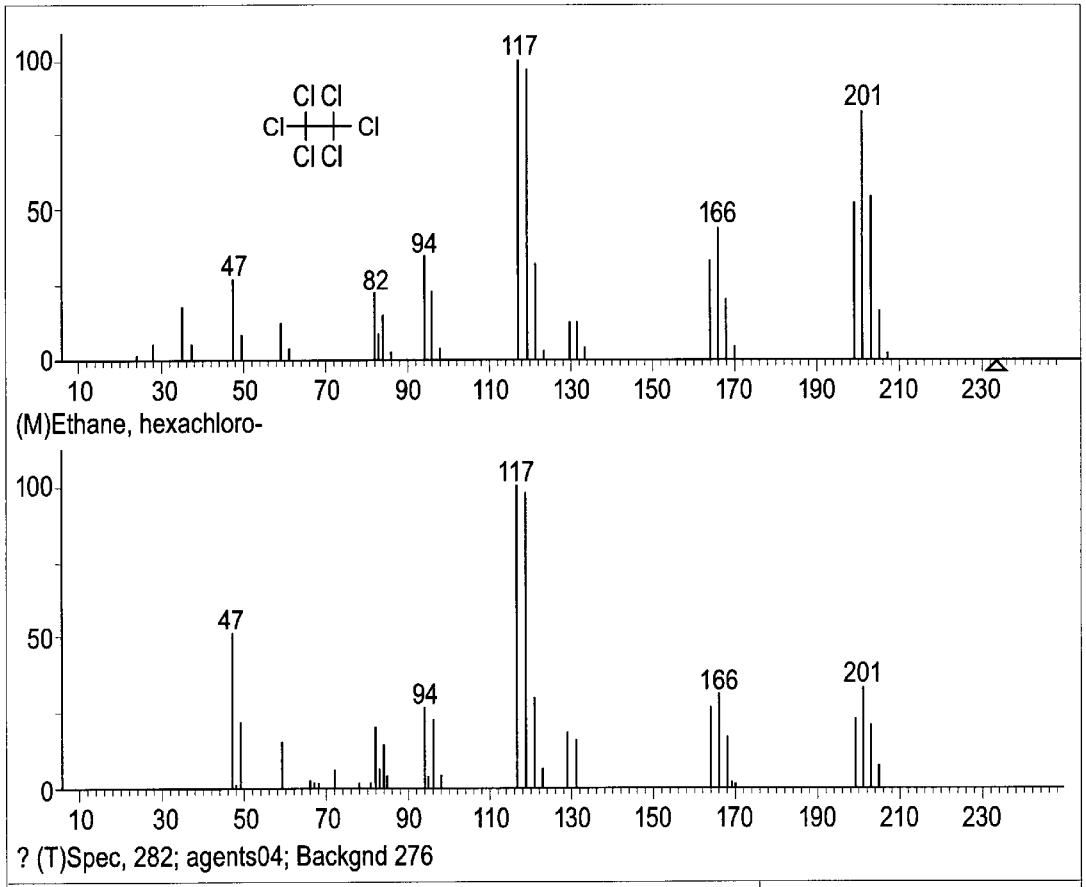

| | | | | |
|---|---|---|---|---|
| 1 | 847 | 882R | 98.0P | (M)Ethane, hexachloro- |
| 2 | 845 | 872P | 0.97 | (M)Methanosulfonyl chloride, trichloro- |
| 3 | 832 | 638R | 0.78P | (M)2-Propanone, 1,1,1,3,3,3-hexachloro- |
| 4 | 590 | 783R | 0.19P | (M)Pyrazine, tetraphenyl- |
| 5 | 547 | 558R | 0.04P | (M)Acetic acid, trichloro-, anhydride |
| 6 | 486 | 785R | 0.00P | (M)Carbon Tetrachloride |
| 7 | 466 | 467R | 0.00P | (M)Propane, 1,1,1,2,2,3-hexachloro-3,3-difluoro- |
| 8 | 458 | 589R | 0.00P | (M)Dichloro[(trichloromethyl)thio]methanesulphenyl c |
| 9 | 440 | 752R | 0.00P | (M)Methane, trichloronitro- |
| 10 | 424 | 592R | 0.00P | (M)Propane, 1,1,2-tribromo- |
| 11 | 412 | 816R | 0.00P | (M)6-Chloromethyl-5-methylidene-anti-3-nortricyclan |
| 12 | 410 | 579R | 0.00P | (M)Silane, dichlorofluoromethyl- |
| 13 | 407 | 585R | 0.00P | (M)Methane, bromotrichloro- |
| 14 | 403 | 823R | 0.00P | (M)Tetrachloroethylene |

| | |
|---|---|
| 1 | (M)Ethane, hexachloro- |
| 2 | (T) Spec, 128; survey02; B |
| 3 | (T) Spec, 597; agents05; B |
| 4 | (T) Spec, 268; agents02; B |
| 5 | (T) Spec, 522; agents04; B |
| 6 | (T) Spec, 262; agents04; B |
| 7 | ?(T) Spec, 282; agents04; |

*Fig. 19c* Mass Spectral Identification of Source Agent Vapour - Chlorinated Alkanes

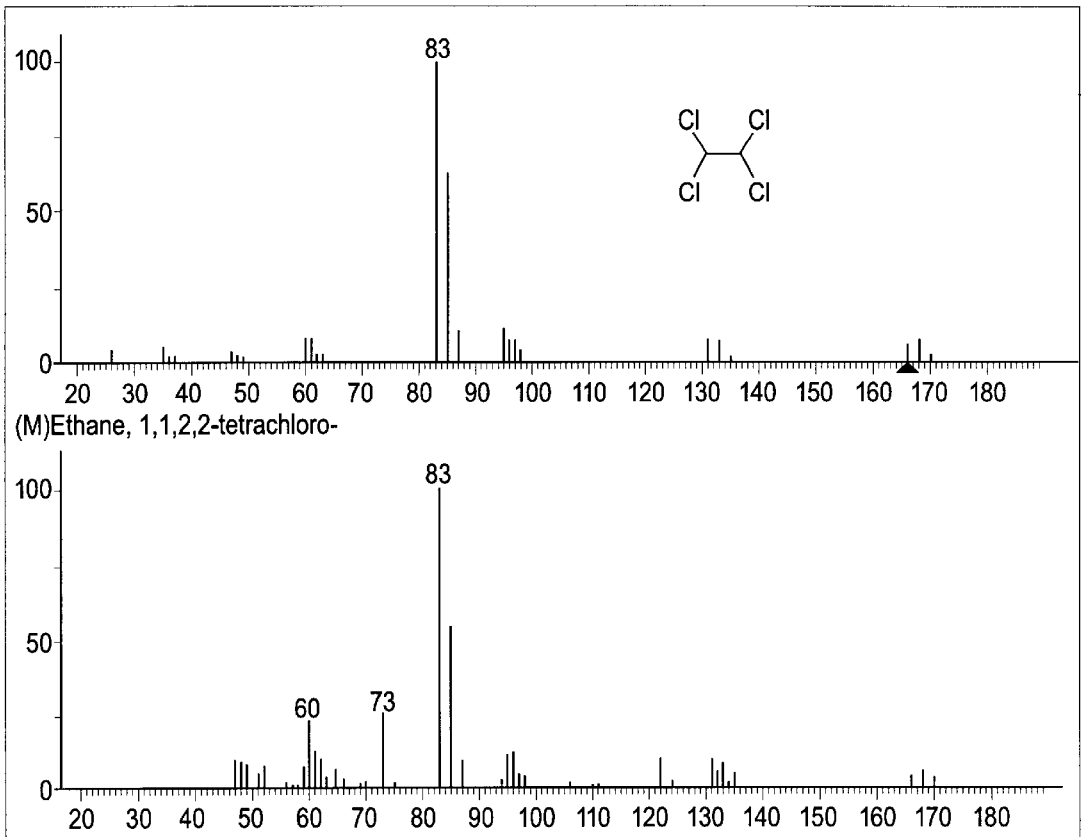

| | | | | | |
|---|---|---|---|---|---|
| 1 | 726 | 816R | 93.8P | (M)Ethane, 1,1,2,2-tetrachloro- | 1 (T) Spec, 128; survey02; B |
| 2 | 566 | 814R | 3.56P | (M)2-Propanone, 1,1,3,3-tetrachloro- | 2 (T) Spec, 597; agents05; B |
| 3 | 538 | 826R | 0.75P | (M)1,4-Methanocyclopropa[3,4]cyclopenta[1,2-c]fura | 3 (T) Spec, 268; agents02; B |
| 4 | 519 | 668R | 0.46P | (M)3,4-Dihydrothieno-(3,4-b)-5-carboxythiophene | 4 (T) Spec, 522; agents04; B |
| 5 | 513 | 706R | 0.37P | (M)Ethane, 1,2,2-trichloro-1,1-difluoro- | 5 (T) Spec, 262; agents04; B |
| 6 | 506 | 634R | 0.29P | (M)Ethane, 1,1,2-trichloro- | 6 (T) Spec, 282; agents04; B |
| 7 | 485 | 616R | 0.18P | (M)Ethane, 1,1,2-trichloro-2-fluoro- | 7 (T) Spec, 282; agents04; B |
| 8 | 484 | 642R | 0.14P | (M)Chloroform | 8 ?(T) Spec, 93; agents04; |
| 9 | 460 | 524R | 0.08P | (M)Ethane, 1,1-dichloro-2,2-difluoro- | |
| 10 | 452 | 520R | 0.07P | (M)Acetyl chloride, dichloro- | |
| 11 | 437 | 566R | 0.04P | (M)3,5-Cychlohexadiene-1,2-dione, 5-(hydroxymethyl) | |
| 12 | 434 | 532R | 0.03P | (M)Cyclopentanepropanoic acid | |
| 13 | 431 | 595R | 0.02P | (M)Acetic acid, dichloro-, methyl ester | |
| 14 | 423 | 428R | 0.02P | (M),beta,-D-Giucopyranose, 4-O-, beta,-galactopyr | |

*Fig. 19d*

| Agent Under Test | w/w% Agent | w/w% SD | SD/ Agent | Buffer Strength | w/w% Foamer/ Surfactant | w/w% Cosolvent | Time (Min) | % Agent Remaining | | LC-MS Ions Monitored |
|---|---|---|---|---|---|---|---|---|---|---|
| | | | | | | | | LC-FPD | LC-MS | |
| GB | 0.29 | 3.0 | 5.7 | 0.67 | 1.3 | 0 | 0.43 | <0.56 | - | - |
| | | | | | | | 3.7 | - | <0.2 | 99.1, 141.1 |
| | | | | | | | 5.6 | <0.56 | - | - |
| | | | | | | | 10.8 | - | <0.2 | 99.1, 141.1 |
| | | | | | | | 56.6 | <0.56 | - | - |
| GB | 0.29 | 6.0 | 11.4 | 1.0 | 4.6 | 6.9 | 1.13 | <0.56 | - | - |
| | | | | | | | 3.52 | - | <0.2 | 99.1, 141.1 |
| | | | | | | | 4.92 | <0.56 | - | - |
| | | | | | | | 10.0 | - | <0.2 | 99.1, 141.1 |
| GB | 0.29 | 9.0 | 17.2 | 1.0 | 4.8 | 6.9 | 1.78 | <0.56 | - | - |
| | | | | | | | 5.43 | <0.56 | - | - |
| GA | 0.29 | 3.0 | 5.7 | 0.67 | 1.6 | 0 | 1.33 | 0 | - | - |
| | | | | | | | 2.43 | 0 | - | - |
| | | | | | | | 4.95 | 0 | - | - |
| | | | | | | | 53.0 | 0 | - | - |
| | | | | | | | 21.8hrs | 0 | - | - |
| GA | 0.29 | 3.0 | 5.7 | 0.67 | 1.8 | 0 | 1.07 | 0 | - | - |
| | | | | | | | 3.43 | - | <0.46 | 163.1 |
| | | | | | | | 4.85 | 0 | - | - |
| | | | | | | | 9.67 | - | <0.46 | 163.1 |
| GA | 0.29 | 6.0 | 11.4 | 1.0 | 4.5 | 7.5 | 1.07 | 0 | - | - |
| | | | | | | | 3.35 | - | <0.46 | 163.1 |
| | | | | | | | 4.85 | 0 | - | - |
| | | | | | | | 10.0 | - | <0.46 | 163.1 |
| | | | | | | | 360 | 0 | - | - |
| GD | 0.29 | 3.0 | 5.7 | 0.67 | 1.6 | 0 | 1.07 | 5.0 | - | - |
| | | | | | | | 2.17 | tr | - | - |
| | | | | | | | 3.53 | tr | tr | 183.1 |
| | | | | | | | 4.77 | 0.5 | - | - |
| | | | | | | | 10.0 | - | <0.06 | 183.1 |
| GD | 0.29 | 6.0 | 11.4 | 1.0 | 4.6 | 7.8 | 1.08 | 4.3 | - | - |
| | | | | | | | 2.22 | tr | - | - |
| | | | | | | | 3.53 | tr | tr | 183.1 |
| | | | | | | | 4.85 | 1.4 | - | - |
| | | | | | | | 9.98 | - | <0.06 | 183.1 |
| HD | 0.27 | 3.0 | 5.7 | 0.67 | 1.6 | 0.0 | 2.67 | 0.0 | - | - |
| | | | | | | | 4.92 | 0.0 | - | - |
| HD | 0.27 | 3.0 | 5.7 | 0.67 | 1.6 | 0.0 | 3.0 | 0.0 | - | - |
| | | | | | | | 5.4 | 6.2 | - | - |
| | | | | | | | 62.1 | 0.0 | - | - |
| HD | 0.27 | 3.0 | 5.7 | 0.67 | 1.6 | 0.0 | 3.65 | 0.0 | - | - |
| | | | | | | | 4.97 | 0.0 | - | - |
| HD | 0.27 | 6.0 | 11.4 | 1.0 | 4.7 | 7.2 | 2.47 | 0.0 | - | - |
| | | | | | | | 5.27 | 0.0 | - | - |
| | | | | | | | 53.3 | 0.0 | - | - |

*Fig. 24*

| Formulation | uL/mL | VX Molar ration SD/VX | mg weighed | Reaction Time (minutes) | Residual VX | Product Toxic? | Notes |
|---|---|---|---|---|---|---|---|
| Buffer/Surfactant | 4 | | | 6 days | 42% | YES | |
| FS* wo/SD | 12 | | | 125 | >50% | YES | VX droplets not solubilizing |
| FS* wo/SD | 12 | | | 6 days | >50% | YES | |
| FS* | 12 | 18.2 | | 24 | 0 | 0 | |
| FS* | 12 | 18.2 | | 7 | 0 | 0 | |
| Mild | 12 | 6.3 | 11.6 | 6 | 24.90% | NO | |
| Mild | 12 | 6.0 | 12.2 | 11 | 20.90% | Trace | |
| Mild | 12 | 6.0 | 12.2 | 15 | 11.40% | Trace | |
| Mild | 12 | 6.2 | 11.7 | 33 | 11.80% | Trace | |
| Mild | 12 | 6.3 | 11.6 | 230 | 19.40% | Trace | |
| Mild | 12 | 6.3 | 11.6 | 3days 23 hrs | 50.10% | Trace | |
| Mild | 12 | 6.3 | 11.6 | 5days | 28.77% | | |
| Mild | 4 | 16.9 | 4.3 | 7 | 1.28% | Trace | |
| Mild | 4 | 18.2 | 4 | 11 | 0.63% | Trace | |
| Mild | 4 | 18.2 | 4 | 66 | 0.65% | Trace | |
| Mild | 4 | 18.2 | 4 | 189 | 0.56% | Trace | |
| Mild | 3 | 29.1 | 2.5 | 12 | 0.68% | Trace | |
| Mild | 0 | 0 | 0 | - | 0 | - | |

* Full 9% SD Strength

*Fig. 25*

DECONTAMINATING AND DISPERSION SUPPRESSING FOAM FORMULATION

CROSS-REFERENCE TO RELATED APPLICATION

This application claims the benefits under 35 U.S.C. §119(e) of U.S. provisional application 60/122,091, filed Feb. 26, 1999, which is incorporated herein by reference in its entirety.

FIELD OF THE INVENTION

This invention relates to foam formulations having both blast-suppressant and decontamination capabilities.

BACKGROUND OF THE INVENTION

Improvised explosive devices (IEDS) represent an increasingly dangerous threat to society, particularly when they contain a toxic chemical/biological (CB) agent. It is vital that both the blast effects (a compression or pressure wave, heat and shrapnel) and the CB agent and aerosols, released from the initiation of such devices, are contained. Once released, CB agents also present a decontamination problem when deposited on the surfaces of various equipment and vehicles, or spilled on the ground.

In the last decade, patents and papers have been published on the use of foam for blast suppression. For example, in U.S. Pat. Nos. 4,541,947 and 4,589,341 to Clark et al., an improved method for blast suppression is disclosed which utilizes fire fighting foams confined in a structural barrier surrounding the blast source. Typically, water-detergent based foams are used, having an expansion 50:1–1000:1. Clark discloses the use of JET-X, from Rockwell Systems Corporation and having 1–6% detergent, containing protein additives and used in the ratio of 1–3 parts by volume for each 100 parts of water. The key to this invention is the methodology for containing a high expansion foam in a desired location.

U.S. Pat. No. 4,964,329 assigned to Broken Hill Ltd. describes a foam composition consisting of a mixture of foamable liquid and a particulate additive to be supported as a dispersion in the foam. The dispersion is claimed to be effective in sound attenuation and shock wave attenuation.

U.S. Pat. No. 4, 442,018 to P. Rand describes a foaming composition which has decreased solution viscosity for high expansion foam capability and decreased liquid drainage. Such a composition comprises a combination of a water soluble polymer of the polyacrylic acid type, a foam stabilizer of dodecyl alcohol, a surfactant, and a solvent. A key is the combination of the stabilizer and polymer used.

A very interesting U.S. Pat. No. 5,434,192 to Thach et al. describes a composition of surfactants and stabilizers consisting of a mixture of modified natural and synthetic polymer and solvents capable of producing foam viable for 12 hours to several days at 75–105 degrees F. Such foam is used to suppress the emission of volatile gases and vapors.

As described in Clark, a blast may be suppressed using foam contained in a barrier. Applicants initially conducted blast tests with a foam product known as aqueous film forming foam (AFFF)—initially designed for knocking down fire. The AFFF was contained in nylon dome tents that were deployed around the blast threat. The blast suppression results were very inconsistent; the foam would break down very quickly and varied from a watery form to very light and airy. The lessons learned during this phase included the realization that the physical form of the foam could be varied considerably by the foam-dispensing rate, the percentage of surfactant in the composition and the foam-dispensing nozzle characteristics. This work led to the development of a containment system described in Applicant's co-pending U.S. application Ser. No. 60/069,533, filed Dec. 12, 1997. That system includes a tent-like enclosure that is deployed over an IED and is filled with an air-aspirated aqueous foam material deemed a Dispersal Suppressant Foam (DSF). When the IED was then detonated, the resulting shrapnel was contained within the enclosure. The foam material used comprised a product sold under the trademark of SILVEX as described by U.S. Pat. No. 4,770,794 to Cundasawmy, which issued on Sep. 13, 1988.

The inclusion of chemical (CW) and biological (BW) warfare agents (collectively CB agents) or radioactive materials into IED's presents an even greater challenge. Not only must the blast be contained, the agents present in the IED must be effectively neutralized within the area of containment to allow personnel access to the site following activation.

Generally, decontamination of radioactive particles is not possible due to their nuclear origin, however, removal by encapsulation significantly reduces aerosolization potential. Decontamination of chemical and biological agents usually occurs by oxidation, reduction or hydrolysis. Ideally a broad spectrum decontaminant, which does not produce toxic by-products in its mode of action on any of the likely contaminants, is of greatest use when the nature of the warfare agent is unknown.

Ideally, the blast suppression and decontamination should be a result of a single process, increasing the efficiency of the operation and allowing access to the site as quickly as possible. Further, vital evidence contained within the suppression zone should not be damaged by either the suppressant foam or by the decontaminating agent.

In order to provide a single step suppression/decontamination foam, decontaminant must be included as a part of the foam formulation. While foam for blast suppression is currently available, as are decontaminants, it is not merely an obvious step to mix them together for the combined purpose of blast suppression and decontamination.

A prior art decontaminant, German Emulsion (C8), was designed to be of low corrosivity, dissolve thickeners and penetrate paint to react with embedded agents in a emulsion formulation. It was discovered however, that the emulsion or foam was somewhat unreliable and sometimes did not form at all. Such decontaminant foams would not be suitable for blast suppression for a period of time after generation.

Any inclusion of ingredients into a foam formulation must be carefully assessed to determine their effect on the bubble size and uniformity within the foam. Further, the new formulation must possess sufficient stability, as indicated by low liquid drainage rates and an acceptable expansion ratio, to continue to provide optimum blast suppression.

As discussed in U.S. Pat. No. 4,442,018 to Rand, the choice of solvent in a foam formulation can have dramatic effects on the solution viscosity and liquid drainage from the foam. Thus, solvents and co-solvents present in decontamination formulations can act effectively as de-foamers if incompatible with the foam formulation. Particulates or oxidizing components present in decontamination formulations may also have significant detrimental effects on foam characteristics.

It remains the challenge to provide an all-in-one, blast suppression and decontamination foam that combines optimum blast suppression characteristics, such as uniform bubble size, slow drainage, vertical cling, vapor suppression and low toxicity and corrosivity, with optimum broad spectrum decontamination characteristics such as solubilization and emulsification of contaminants, rapid and complete degradation of chemical and biological warfare agents to non-toxic products and low toxicity and corrosivity.

SUMMARY OF THE INVENTION

The present invention discloses the discovery that a foam formulation exists which is suitable for both blast suppressing and decontamination, particularly desirable when faced with an explosive device which has been rigged with a contaminant for destructive dissemination. In the known cases of blast suppression, a contaminant can be shown to be substantially contained by a foam, but the used foam becomes heavily contaminated.

Accordingly, a serendipitous foam formulation is provided, combining both the advantages of blast suppression and chemical and biological agent decontamination.

A foam formulation which is compatible with a decontaminant includes the following compositions:

for the surfactant, $[R_nH_{2n+1}(OCH_2CH_2)_mSO_4^{2-}M]$, where R is an alkyl group having from eight to fourteen carbon atoms, m is an integer from 1 to 3, and M is Na+ or $NH_{4+}$, in mixture with $CH_3(CH_2)_n CH{=}CHCH_2SO_3Na$, for the co-solvent, $HO(CH_2(CH_3)CHO)_nH$ (PPG of MW about 425) where n=5–49 and most preferably 7; and for the foam stabilizer, R—OH where $R{=}C_{10}$–$C_{14}$.

The decontamination components compatible with the above foamer include hydrated chloroisocyanuric acid salts, preferably chloroisocyanuric acid is selected from the group consisting of an alkali metal of monochloroisocyanuric acid, dichloroisocyanuric acid, and a combination thereof with cyanuric acid. A preferred alkali metal of dichloroisocyanuric acid is sodium dichloroisocyanurate.

Accordingly, a preferred decontamination formulation suitable also for blast suppression comprises:

about 1% to 6% by weight and preferably from about 1% to about 3% by weight of hydrated chloroisocyanuric acid salts and more preferably lithium hypochlorite in a ratio of 5–10% of the chloroisocyanuric acid salts;

about 1% and optionally up to 8% of a co-solvent selected from the group consisting of polypropylene glycols, polyethylene glycols, and derivatives and mixtures thereof;

from about 1% to about 5% of a surfactant;

a buffer system to initially maintain said formulation at a pH from about 8.5 to about 11 for a minimum of 30 minutes and preferably initially, from about 10 to about 11; and the balance being water.

In the preferred formulation, the foamer components have a preferred composition of about 15 w/v % of the sodium salt of an ether sulphate of the formula $CH_3(CH_2)_{11}(OCH_2CH_2)_3OSO_3Na$; 7.75 w/v % of a sodium olefin sulphonate of the formula $CH_3(CH_2)_nCH{=}CHCH_2SO_3Na$ where n=10 to 12, comprising a total of 22.75 w/v % surfactant;

about 10–25 w/v % of polypropylene glycol co-solvent of the formula $H(OCH(CH_3)CH_2)_nOH$ where n=5 to 9;

about 1–2.5 w/v % of an alcohol $CH_3(CH_2)_nOH$ where n=8 to 16 to act as a foam stabilizer; and optionally about 0.3% by weight of the above corrosion inhibitors; and the balance being water.

Accordingly, a novel method of handling explosive devices is now available. In a broad aspect, a method for dispersal suppression of an explosive CB contamination device comprises the steps of:

surrounding the explosive contamination device with a containment structure;

and filling the containment structure with an aerated foam comprising both, a high expansion foamer; and a foamer-compatible decontamination formulation effective on chemical and biological agents without significantly and adversely affecting the formation of foam. Preferably a foamer is prepared from a surfactant, a co-solvent selected from the group consisting of polypropylene glycol, polyethylene glycol, and derivatives and mixtures thereof, and a foam stabilizer; a decontamination formulation is prepared from a chloroisocyanuric acid salts, and a buffer to maintain said formulation at a pH from about 11 to about 8.5; mixing the foamer and decontamination formulation in water; and foaming the mixture.

In a novel combination, a system is provided for dispersal suppression of an explosive CB contamination device comprising:

a containment structure for surrounding the explosive contamination device; and aerated foam contained within the structure being formed from a decontamination formulation in water comprising a surfactant, a foam stabilizer, a solvent selected from the group consisting of polypropylene glycol, polyethylene glycol, and derivatives and mixtures thereof, chloroisocyanuric acid salts, and a buffer to maintain said formulation at a pH from about 11 to about 8.5.

In the preferred use for surrounding an explosive device, the foam formulation in water comprises about 0.4–4 weight % of a surfactant; about 0.03–0.5 weight % of a foam stabilizer; and about 0.10–9.5 weight % of a co-solvent; about 3–6 % of the chloroisocyanuric acid salts; the buffer and the balance being water. Preferably, and still effective for decontamination and foaming capability is a formulation 0.6 weight % of the surfactant; about 0.03 weight % of the foam stabilizer; about 0.75 weight % of the co-solvent; and about 3% of the chloroisocyanuric acid salts.

BRIEF DESCRIPTION OF THE DRAWINGS

FIG. 1 illustrates the concentration values of methyl salicylate (mustard simulant) in the test chambers, after two baseline shots (no enclosure) and three test device shots (enclosure with foam+placement of a tent over the device followed by the injection of DSF). The percentage of agent capture and containment exceeded 90%;

FIG. 2 illustrates the concentration gradient that was measured in the test chamber over a thirty minute duration—NOTE: These are the same shots as in FIG. 1, Baseline shots not shown as the scale was too large. This is still within acceptable limits but has prompted an effort to make further improvements to the foam mitigating capacity;

FIG. 3 illustrates the comparison between unmitigated Baseline shots and Test shots of Example 2. Simulant formed a fine aerosol that behaved like that of a biological agent. The percentage of agent captured was in the order of 95%;

FIG. 4 shows the over pressure readings collected by a pressure transducer placed at 1.5 meters. The Baseline shots were between 6 and 7 Pounds per Square Inch (psi). The Test shot readings were almost negligible. The enclosure did not tear, all contents remained in the tent;

FIG. 5 depicts the concentrations of simulant in the test chambers of Example 3 after an unmitigated baseline shot and a contained shot. As well, the lethal level of Sarin for a one minute exposure is displayed. A high level of simulant capture is noted;

FIG. 6 illustrates the over pressure measurements at the noted distances from the device for both an unmitigated and a contained shot. The findings indicated over pressure containment in the order of 90%;

FIG. 7 represents the air concentrations of simulant as measured by DAAMS Tube Samplers in an outdoor trial as noted in FIG. 8. This simulated a device being initiated outside of a structure. The data recorded during the Test Device shot indicated containment greater than 95%;

FIG. 8 illustrates the Range DAAMS Tube Sampler Setup;

FIG. 9 illustrates the over pressures recorded on two tests, an unmitigated test and a contained test. The readings recorded on the contained shot were barely measurable <1 psi;

FIG. 10 depicts one baseline unmitigated shot, and three contained test shots with different explosive amounts as noted. Samplers set as noted in FIG. 8. Containment realized in excess of 95%; and FIG. 11 shows the over pressure values measured at 1.5 meters from the test device unmitigated and three contained shots, each with different explosive loads as noted. Over pressure values were diminished by greater than 95%.

FIGS. 12–19*d* relate to Example 4.

FIG. 12 represents a total ion chromatogram created from Hapsite data after simulant dispersal showing a single organic chemical with a predominant mass 115 fragment, consistent with diethyl malonate;

FIG. 13 shows the results of the mass spectral data analysis indicating that the chemical in FIG. 12 is indeed diethyl malonate with a probability of 97.5%;

FIG. 14 shows total ion chromatograms of Hapsite™ readings following vehicle contamination with mustard, prior to application of the foam formulation;

FIG. 15 shows mass spectral identification of the sample in FIG. 14, containing a predominant mass 109 fragment, as being mustard (bis (2-chloroethyl) sulphide);

FIG. 16 shows total ion chromatograms of Hapsite data from air samples acquired after vehicle decontamination showing the absence of mustard vapor;

FIG. 17 shows total ion chromatograms of two separate air samples of tent head-space air, taken at 20 seconds and at one minute during the 5 minute sampling period, following activation of the device;

FIG. 18*a* shows the total ion chromatogram of the mustard sample, sampled by Hapsite, from the head-space air of the bottle containing mustard, used for vehicle contamination trials;

FIG. 18*b* shows the total ion chromatograms from the mustard head-space air sample of FIG. 18*a*, showing additional solvent components;

FIGS. 19*a*–19*d* show mass spectral library identification chromatograms used to identify the constituents in the mustard head-space air sample of FIG. 18*a;*

FIG. 20 shows a total ion chromatogram of an air sample acquired by Hapsite during the Example 5 simulant dispersal trial showing the sample to contain a high concentration of a single component, subsequently identified as DEM;

FIG. 21 shows a total ion chromatogram of a head-space air sample above a bottle of mustard agent acquired by Hapsite showing a total ion and mass 109 reconstructed ion chromatogram identifying the substance as mustard;

FIG. 22 shows a total ion chromatogram of the tent head-space air sample acquired by Hapsite 10 minutes after detonation in the simulant trial showing a small amount of simulant and dichloroethyl acetate;

FIG. 23 shows a total ion chromatogram of the tent-head-space air sample acquired by Hapsite after detonation in the mustard trial, not to be mustard, but to be 1,2-dichloroethane instead;

FIG. 24 is a table illustrating the effectiveness of several decontaminant formulations against selected G-type nerve gases GB, GA and GD and mustard gas, HD;

FIG. 25 is a table illustrating the effectiveness of a foam formulation containing 9% active ingredient (FS) and one containing 3% active ingredient (Mild) against the nerve agent VX.

DESCRIPTION OF THE PREFERRED EMBODIMENTS

Figure 1:
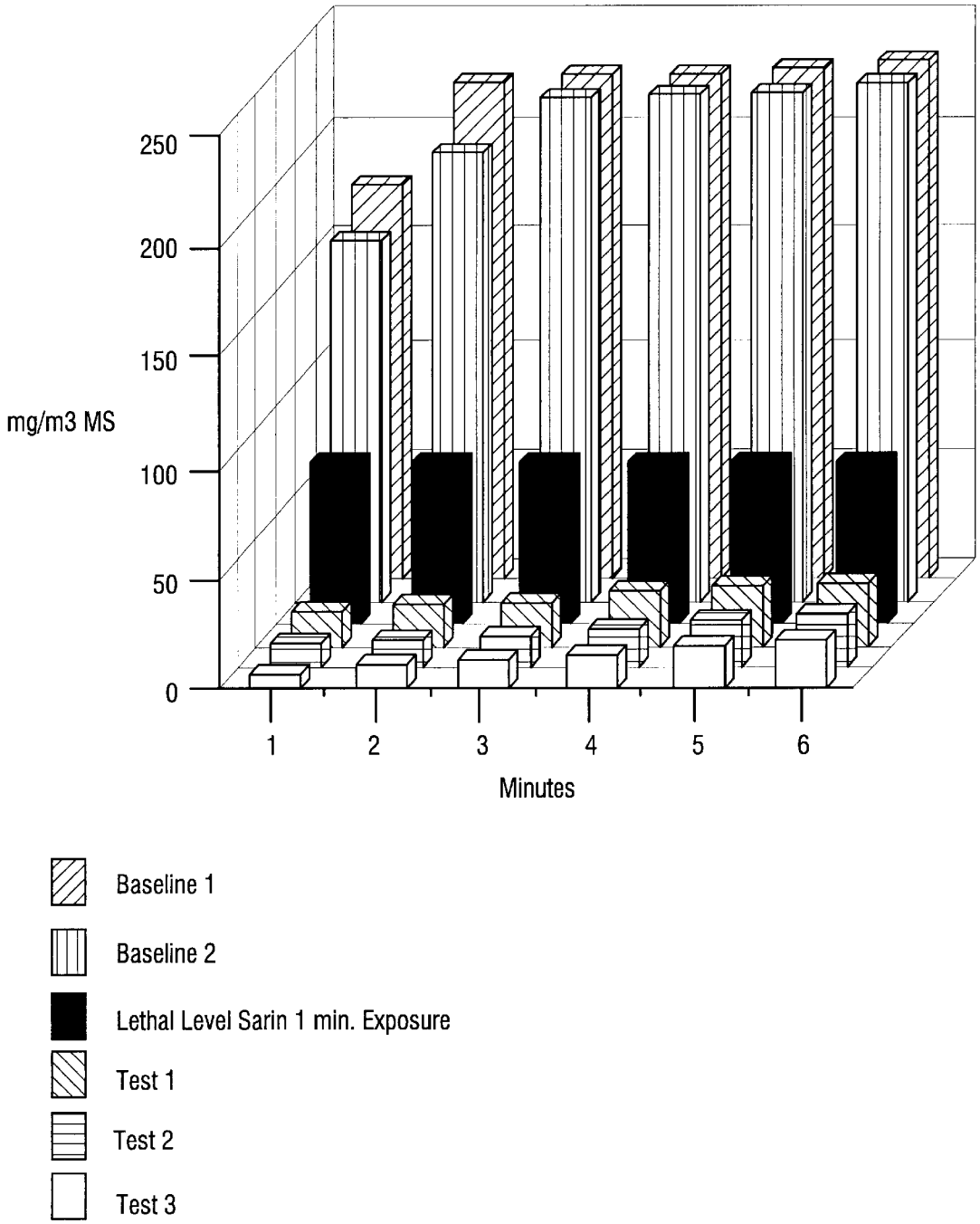
FIGS. 1–4 relate to Example 2.

In the present invention, a blast suppressing decontamination foam formulation and means for its use are provided for incorporating the known active decontamination ingredient, hypochlorite, in a uniquely buffered solution designed to be incorporated into a blast suppressing foam to be used to suppress the blast shock wave, contain shrapnel and toxic vapors following detonation of IED's and decontaminate chemical and warfare agents contained therein.

Generally

Incorporation of known decontaminant solutions into existing blast suppressing foam formulations requires careful testing and optimization to ensure that neither of the component formulations suffers adverse effects with respect to their intended purpose.

Particularly, incorporation of solvents and particulates into foam formulations may adversely effect those characteristics required for blast suppression, those characteristics being slow liquid drainage rates, high expansion ratios and optimum bubble size.

Further the addition of foam agents and solvents into decontaminant solutions should not alter the effective pH ranges of the active ingredients and stabilizers, nor should it result in the production of toxic by-products or cause false positive or negative readings on monitoring equipment.

Formulations which are suitable for the suppression of blasts are discussed in co-pending U.S. provisional patent application 60/120,874, filed Feb. 19, 1999, and replaced by a regular application filed on or about Feb. 18, 2000, which is incorporated herein by reference in its entirety.

In co-pending application 60/120,874, it was determined that a suitable foamer concentrate comprising (a) a surfactants 40–80%/w; (b) a foam stabilizer 3–7 %/w; (c) a polyalkyleneglycol solvent 10–30%/w; and (d) water balance to 100%.

The surfactants was a mixture of two surfactants. The use of the term surfactant herein is defined as individual or a mixture of surfactants as set forth in the context.

Foam Formulations

As suggested, a foam formulation generally comprises a surfactant, a co-solvent and a stabilizer.

The surfactant is capable of acting as an emulsifier and forms a foam, over a wide range of pH, when aerated. Ideally the surfactant should be soluble in fresh or seawater and is chosen to be compatible with other ingredients in the foam formulation. The surfactant may be a single ingredient or a mixture of two or more surfactants such as Cedepal® TD-407, a sodium alkyl ether sulfate, and Bioterge® AS-90, an alpha olefin sulphonate.

The co-solvent acts as a coupling agent for solubilizing the surfactant and as solubilizer for chemical warfare agents that are not water soluble. The term co-solvent is used herein to define organic-based chemicals that solubilize CB agents, e.g. from alkyd-coated (painted) surfaces. One such co-solvent is polypropylene glycol (PPG425). The PPG425 still permits good foaming characteristics over a wide range of pH in both fresh and seawater.

The stabilizer acts to increase foam stability. Long chain, often water insoluble, polar compounds with straight chain hydrocarbon groups of approximately the same length as the hydrophobic group of the surfactant, such as long chain fatty acids, act as foam stabilizers. One such stabilizer is dodecanol:Lorol® 70:30 which is a blend of C12–14 aliphatic alcohols in the ratio of 70:30. Another is Alfol® 1412, a mixture of 1-dodecanol and 1-tetradecanol.

Briefly, the foamer consists of a surfactant, a co-solvent and a foam stabilizer. Optionally, in addition, corrosion inhibitors can be added in very small quantities.

Generally, suitable surfactants include a composition of either the formula $[R(OCH_2CH_2)_nX]_aM_b$, where R is an alkyl group having from eight to eighteen carbon atoms, n is an integer from 1 to 10; X is selected from the group of $SO_3^{2-}$, $SO_4^{2-}$, $CO_3^{2-}$ and $PO_4^{3-}$: M is an alkali metal, alkaline earth metal, ammonium or amine derivative; a is the valence of M and b is the valence of $[R(OCH_2CH_2)_nX]$ and the formula $[R—CH{=}CH(CH_2)_m—X]_aM_b$ where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium or amine derivative, a is the valence of M and b is the valence of $[R—CH{=}CH(CH_2)_m—X]$ or a mixture thereof.

A suitable foam stabilizer is an alkyl alcohol, R—OH, where R is an alkyl group having from eight to sixteen carbons.

Combined, one such suitable foamer is Silv-Ex™ made by Ansul Fire Protection described in U.S. Pat. No. 4,770,794 issued to Cundasawmy et al. Sep. 13, 1988. More specifically, the Silv-Ex formulation consists of a surfactant comprising: 20% by weight of a surfactant $C_{10}H_{21}(OCH_2CH_2)_{2.3}SO_4^-Na^+$ and 20% by weight of $C_{14}H_{29}(OCH_2CH_2)_3SO_4^-NH4^+$; a co-solvent of 20% by weight of diethylene glycol monobutyl ether; and a stabilizer of 5% by weight of $C_{12}H_{25}OH$. The balance is water. Optionally, the formulation contains a further 0.5% of corrosion inhibitors.

Alternatively, foamers which do not contain diethylene glycol monobutyl ether as the co-solvent are preferable, as residuals of this low molecular weight constituent can be detected by some conventional decontamination monitoring equipment (such as Graseby Ionics™ Chemical Agent Monitor or CAM) and are thus interpreted falsely as positive detection of residual contaminant.

Accordingly, a suitable non-residual foamer (or NR-foamer) consists of a composition of alkyl ether sulphate salt, an alpha olefin sulfonate, a co-solvent, an alkyl alcohol, and water. More specifically the surfactant, co-solvent and foam stabilizer are in mixture in water, the component formulas being:

for the surfactant, $[R_nH_{2n+1}(OCH_2CH_2)_mSO_4^{2-}M]$, where R is an alkyl group having from eight to fourteen carbon atoms, m is an integer from 1 to 3, and M is Na+or $NH_4^+$, in mixture with $CH_3(CH_2)_nCH{=}CHCH_2SO_3Na$, for the co-solvent, $HO(CH_2(CH_3)CHO)_nH$ (PPG of MW about 425) where n=5–49 and most preferably 7; and for the foam stabilizer, R—OH where $R=C_{10}–C_{14}$ Accordingly, one preferred composition of the NR-foam formulation consists of about 30% weight/volume of the sodium salt of an ether sulphate of the formula $CH_3(CH_2)_{11}(OCH_2CH_2)_3OSO_3Na$; 15.5 w/v % of a sodium olefin sulphonate of the formula $CH_3(CH_2)_nCH{=}CHCH_2SO_3Na$ where n=10 to 12;

about 20 w/v % of polypropylene glycol co-solvent of the formula $H(OCH(CH_3)CH_2)_nOH$ where n=5 to 9;

about 5 w/v % of an alcohol $CH_3(CH_2)_nOH$ where n=8 to 16; and optionally about 0.3% by weight of optional corrosion inhibitors such as sodium tolyltriazole, ammonium dimolybdate and sodium pentahydrate silicate; and the balance being water, with additional water being added to dissolve other components.

Further, this NR-foamer is capable of generating foam of uniform bubble size, is capable of coating vertical surfaces, is compatible with water, gray water and seawater as the main solvent, and is readily removed following decontamination by rinsing with water.

This particular NR-foamer is subject to soft thixotropic gelling at temperatures below about 10° C., which could be troublesome if shipped or used in adverse weather at this concentration.

It has been determined that to lower the thixotropic gelling point of the surfactant, to be useful in a wider range of environments, one approach is to provide an alcohol stabilizer component which comprises more $C_{12}$ than $C_{14}$. It has been found that, even more significantly, diluting the surfactant 1:1 with water for storage and transport further lowers the gelling point.

Accordingly, a more dilute NR-foamer consists of:

about 15 w/v % of the sodium salt of an ether sulphate of the formula $CH_3(CH_2)_{11}(OCH_2CH_2)_3OSO_3Na$; 7.75 w/v % of a sodium olefin sulphonate of the formula $CH_3(CH_2)_nCH{=}CHCH_2SO_3Na$ where n=10 to 12, comprising a total of 22.75 w/v % surfactant;

about 10–25 w/v % of polypropylene glycol co-solvent of the formula $H(OCH(CH_3)CH_2)_nOH$ where n=5 to 9;

about 1–2.5 w/v % of an alcohol $CH_3(CH_2)_nOH$ where n=8 to 16 to act as a foam stabilizer; and optionally about 0.3% by weight of the above corrosion inhibitors; and the balance being water.

Accordingly, to provide the required concentration of foamer ingredients in the final foam formulation, twice the volume of this diluted foam formulation must be added to the decontaminant and buffer solutions to provide the preferred blast suppressing/decontamination foam formulation.

Decontamination Formulation

More detail on the decontamination formulation is disclosed in a co-pending U.S. provisional patent application 60/120,971, filed Feb. 19, 1999, and which was replaced by a regular application filed Feb. 14, 2000, and which is incorporated herein by reference in its entirety.

Used as a decontaminating formulation alone, and as disclosed in co-pending application 60/120,971, the decontamination formulation comprises an active decontamination agent in a buffer system designed to optimize the initial reaction pH above 8.5 and more preferably in the range of 10 to 11 for favoring hydrolysis of G-agents, and oxidation of VX and HD agents.

Active Ingredient

The decontamination formulation of the present invention contains as an active ingredient, sodium dichloroisocyanurate. Other chloroisocyanuric acids, their alkali metal salts or a combination of acids including trichloroisocyanuric acid are also suitable for use as the active ingredient. As an example, alkali metal salts of monochloroisocyanuric or dichloroisocyanuric acid or a combination of any of the above salts with cyanuric acid may be used.

The decontamination formulation contains from about 1% to about 15%, and preferably from about 3% to about 9%, by weight, of the hydrated dichloroisocyanuric acid salt when used for decontamination alone. When used simultaneously as a blast suppressant, the formulation contains from about 1% to about 6% by weight, of the hydrated dichloroisocyanuric acid salt and preferably from about 3% to about 6% by weight, of the hydrated dichloroisocyanuric acid salt. The formulation may additionally comprise lithium hypochlorite to enhance the activity of the dichloroisocyanuric acid salt.

Buffer

The decontamination formulation of the present invention further comprises a buffer that temporarily maintains an initial pH in the range of 10 to 11, sufficient to enable hydrolysis of G-agents and favor oxidation of the V and mustard agents so as to produce non-toxic products. An initial pH in the range of 10 to 11 is sufficient to provide adequate hypochlorite ions for decontamination. Subsequently, it is desirable that the buffer fail, allowing the pH to decrease eventually to a more neutral pH to enable more efficient destruction of the BW agents.

As the buffer fails and the pH drops to a more neutral pH, hypochlorous acid becomes more prevalent as hypochlorite ions react with available hydrogen ions. Hypochlorous acid is the more active species with respect to the destruction of BW agents as neutral species are able to enter the BX agent cell more easily. Should a BW agent survive the initial decontamination, the BW agent and decontamination formulation may continue to co-reside over time, perhaps after rinsing, and, as the pH falls, BW agent decontamination continues at an even more effective pH. Further, from an environmental standpoint, a more neutral final pH of the decontamination formulation is less hazardous.

It is important to maintain the initial moderately high pH over a prescribed duration (such as a NATO designated duration of 30 minutes for a military decontamination), to provide sufficient hypochlorite ions to effect decontamination—favoring hydrolysis of G-agents, favoring oxidation of VX agent which avoids the formation of toxic hydrolysis byproducts, and favoring oxidation of HD agents and avoiding HD reformation. Accordingly, the buffer must be capable of buffering the release of HCl due to hydrolysis of the chloroisocyanuric salts by water. Most preferably, the pH is maintained above 8.5 during the duration available for decontamination.

It has been determined that the most suitable buffering system is an inorganic buffering system, adjusted to an initial pH in the range of 10 to 11. Sodium salts, such as a mixture of sodium tetraborate decahydrate and anydrous sodium carbonate, are preferable since quaternary ammonium compounds result in depletion of hypochlorite through reaction with the hydrolysis product of hypochlorite, chloride ion.

Augmented Active Ingredients

The decontamination formulation may further optionally include lithium hypochlorite to augment the active hypochlorite content of the solution over a short term, thus providing a higher level of active species in the initial stages after the addition of water. Preferably, lithium hypochlorite is present in amounts in the range of from about 5 to about 10% by weight of the active ingredient dichloroisocyanuric acid salt and taking into account that commercially available lithium hypochlorite is normally only available as 30% pure. Alternatively, small amounts of Super Tropical Bleach (STB) or High Test Hypochiorite (HTH), below their solubilisation limits so that no solid or slurry results, could serve the same function as the addition of lithium hypochlorite.

The decontamination formulation of the present invention may further optionally include inorganic/organic bromide to increase the reactivity of the chloroisocyanuric acid and generate low levels of hypobromite and bromine chloride.

Blast Suppressing-decontamination Foam Formulation

Therefore, in the present invention, a foamer compatible decontamination formulation is mixed with foamer to provide a preferred foam formulation capable of simultaneous blast suppression and decontamination comprising;

from about 1% to 6% by weight and preferably from about 1% to about 3% by weight of hydrated chloroisocyanuric acid salts and more preferably lithium hypochlorite in a ratio of 5–10% of the chloroisocyanuric acid salts;

about 1% and optionally up to 8% of a co-solvent selected from the group consisting of polypropylene glycols, polyethylene glycols, and derivatives and mixtures thereof;

from about 1% to about 5% of a surfactant;

a buffer system to initially maintain said formulation at a pH from about 8.5 to about 11 for a minimum of 30 minutes and preferably initially, from about 10 to about 11; and the balance being water.

It was tested and determined that the addition of 3% active ingredient and buffer into the foamer had substantially no adverse effects on blast suppression effectiveness, the expansion ratios of the foam or on its liquid drainage rates. It was further determined that the foamer did not affect the ability of the active ingredient to effect total decontamination of CB agents.

Should the IED have already detonated, then clean up may be required by a decontaminant with minimal or no blast suppression capability. For example, a 6% active ingredient formulation can be used. In such an instance, additional co-solvent can added to raise the total co-solvent (foamer and added co-solvent) to about 8% for more effectively solubilizing penetrated CB agents from surfaces.

The combined foamer and decontamination formulation can now be applied to IED's which contain a contaminant which would require both blast suppression and decontamination capabilities.

As described in more detail in co-pending provisional application 60/120,874 disclosing blast suppressing foam formulations and also in co-pending provisional application 60/069,533, filed Dec. 12, 1997 and its replacement regular application (both of which are incorporated herein in its entirety), an explosive device including explosive contamination device, is surrounded by an encapsulating foam containment structure. The foamer and decontamination formulation are mixed in water and foamed to fill the containment structure, thereby surrounding the IED.

EXAMPLES

Example 1

Decontamination Effectiveness Evaluations

In the process of foam formulation optimization, the three most promising formulations, # 1, #3 and #4 in Table 1, incorporating the PPG425 co-solvent, were prepared and evaluated for their agent simulant solubilisation capabilities (ability to dissolve and solubilize compounds simulating real agents).

TABLE 1

Percentage Composition of Components in New Candidate Foam Formulations.

| Ingredients | #1 | #2 | #3 | #4 | #5 |
|---|---|---|---|---|---|
| Alkyl Ether Sulfate (FA-406) | 30 | NIL | NIL | NIL | 30 |
| Alkyl Ether Sultate (TD-407) | 26 | 26 | 26 | 26 | NIL |
| α-olefin Sulfonate (AS-90) | NIL | 15.5 | NIL | NIL | 15.5 |
| α-olefin Sulfonate (Stepantan AS 12) | NIL | NIL | 15.5 | NIL | NIL |
| Sulfosuccinate (Aerosol OT) | NIL | NIL | NIL | 50 | NIL |
| Lauryl Alcohol | 5.0 | 5.0 | 5.0 | 5.0 | 5.0 |
| Co-Solvent | 20.0 | 20.0 | 20.0 | 20.0 | 20.0 |
| Citric Acid to pH 7.5 | | | | | |
| Water QS to 100% | | | | | |

It was assessed that all three formulations were equal in their effectiveness in reducing the capacity factors or retention times of test simulants on an HPLC assessment column.

Further work demonstrated that all three formulations met their requirements for limited inhibition of decontamination reaction times with formulation #3 being the preferred formulation. All subsequent testing and field tests were performed using formulation #3.

The decontaminating solution was then prepared by combining two solutions as follows:

1) A buffer solution consisting of:
   a) sodium tetraborate decahydrate, used at a concentration in the decontamination solution so as to produce 0.004167 mol/L after being mixed with the surfactant solution; and
   b) anhydrous sodium carbonate used at a concentration in the decontamination solution so as to produce a molar concentration of 0.0333 mol/L after dilution with the surfactant solution.
2) An oxidizing/decontaminating agent, sodium dichloro-s-triazinetrione (more commonly known as sodium dichloroisocyanuric acid), with a chlorine content of 62% w/w. This material was used at a concentration so as to produce a concentration of 3% w/w in the final solution. It must be pointed out that the oxidizing agent displays signs of precipitation on standing at concentrations above 2%.

It was surprising to see that the simultaneous use of the decontamination and foaming solutions had no adverse effect on the foaming characteristics of the blast foam formula #3; there was no change in foam expansion and drainage rate.

Furthermore, the foaming solution and the buffer/oxidizing agent solution were directly mixed and foam characteristics were measured as a function of time. It was found that there was no drop in expansion ratio nor increase in drainage rate after the mixture had been standing for over 30 minutes.

Example 2 and 3

Two test series were conducted to determine the mitigation capacities of foam formulations to contain CB agents.

The first series of tests, Example 2, were performed using non-fragmenting explosive dissemination models designed to project CB simulants. SILVEX foam formulation was used and the results extrapolated to other foam formulations based on blast tests conducted using the formulation of this invention.

The second series, example 3, studied the performance of the preferred foam formulation, when challenged by non-explosive dispersal models as well as by high energy devices. The high energy explosive dispersal models provided an indication of the upper device limits that were containable.

During the development stage the nylon tent, used in Example 2, was reinforced by adding a layer of ballistic material over the foamed enclosure. Two ballistic materials were tested; DYNEEMA and KEVLAR. Each fabric was tested alone and in combinations with the other. DYNEEMA was selected as the fabric to be used in the containment structure because it demonstrated superior qualities in capturing high velocity bomb fragments. The dome tent shaped design evolved to a base unit being fabricated from 3 layers of DYNEEMA and an outer and inner layer of rip stop nylon. Two containment structure sizes were produced, one approximately 2.75 meters in diameter and the second approximately 2 meters in diameter (used in Example 3). The contaminant system is the subject of co-pending U.S. application serial no. 60/069,533, filed Dec. 12, 1997, and replaced by a regular application, both of which are incorporated herein in their entirety.

Example 2

The Chemical Agent Device Model used was a simple device that included a 1 liter high density polyethylene laboratory bottle and a center burster of approximately 125 grams of C-4 explosive, initiated by an electric blasting cap. The bottle was filled with approximately 950 milliliters (mL) of methyl salicylate, a chemical agent simulant for mustard agent.

The Biological Agent Device Model used was essentially the same design as was used in the chemical simulant test, except that the methyl salicylate was replaced by a biological agent simulant, calcium hydroxide.

The tests were conducted in a cylindrical shaped blast test chamber, 32 feet in diameter and 20 feet high.

A four person, dome shaped nylon tent, 2 meters in diameter was used to contain the foam formulation. The foam formulation used was SILVEX foam concentrate diluted to 1.7 %/w in water. It will be appreciated by those skilled in the art that these results can be extrapolated to other foam formulations according to the invention based on the evaluation of various physical properties of the foam produced with these formulations as compared to SILVEX foams, and a blast test with a preferred formulations against an actual improvised chemical dispersant device containing weapons grade material. Similar blast mitigation properties were observed.

Effectiveness of chemical containment was measured using a miniature infra-red gas analyzer (MIRAN™). Biological containment was determined using an airborne aerosol mass concentration determination wherein simulant is collected on a filter pad in a Gillian Personnel Sampler pump and airborne aerosol mass concentration is extrapolated given known flow rates and chamber volume. Blast overpressures were determined using ENDEVCO™ piezoresistive pressure transducer and Anderson blast gauges.

Two baseline tests were performed without an enclosure or foam formulation to determine the dispersal of the methyl salicylate, mustard simulant. Three tests were performed using the containment tent and the foam formulation. The results, as shown in FIG. 1, show that compared to the baseline test, the tent and foam formulation were able to contain the mustard simulant in excess of 90%.

Figure 2:
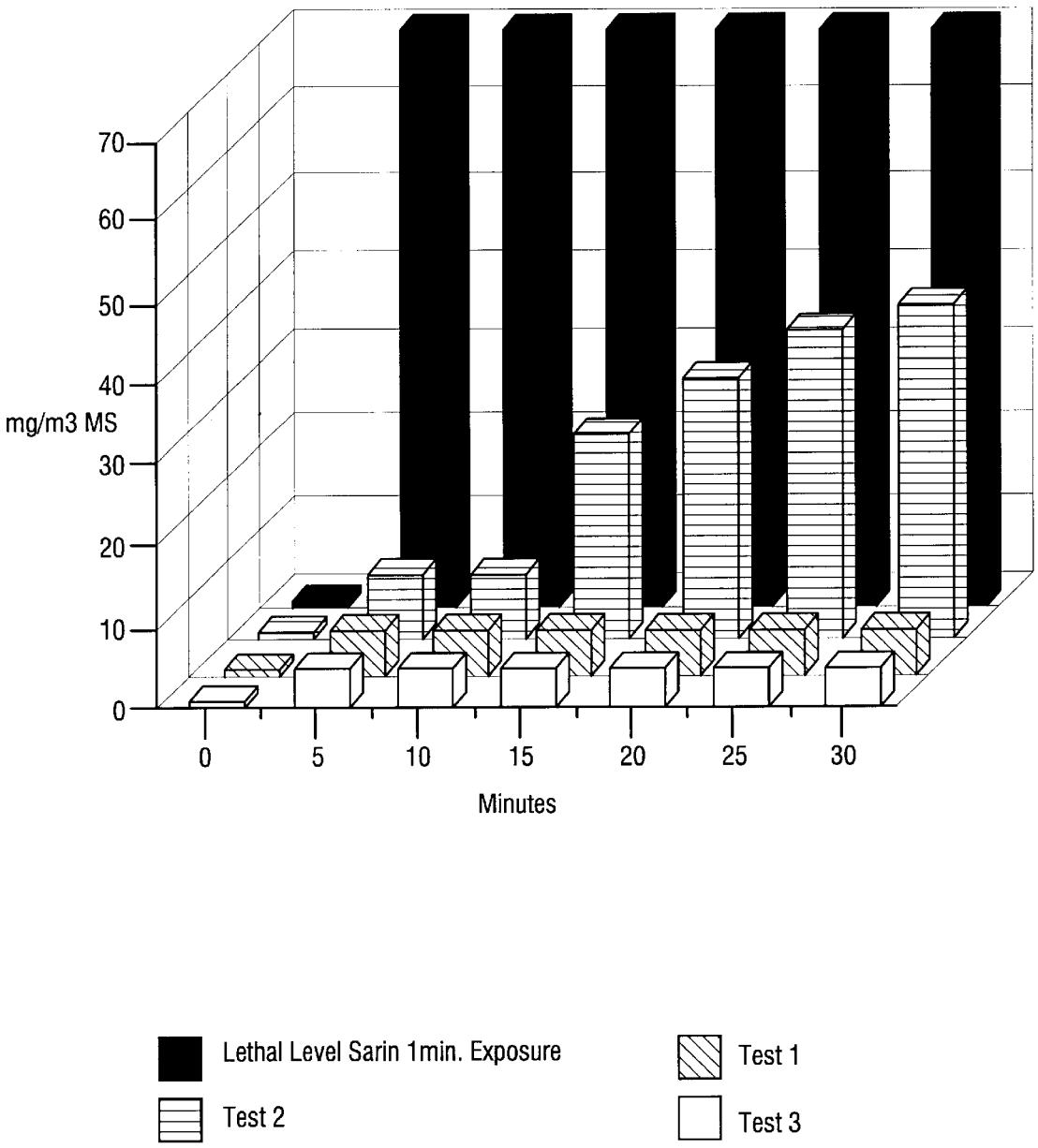

FIG. 2 illustrates the concentration gradient of simulant in the test chamber, over 30 minutes, for the three tests performed in Example 1.

Figure 3:
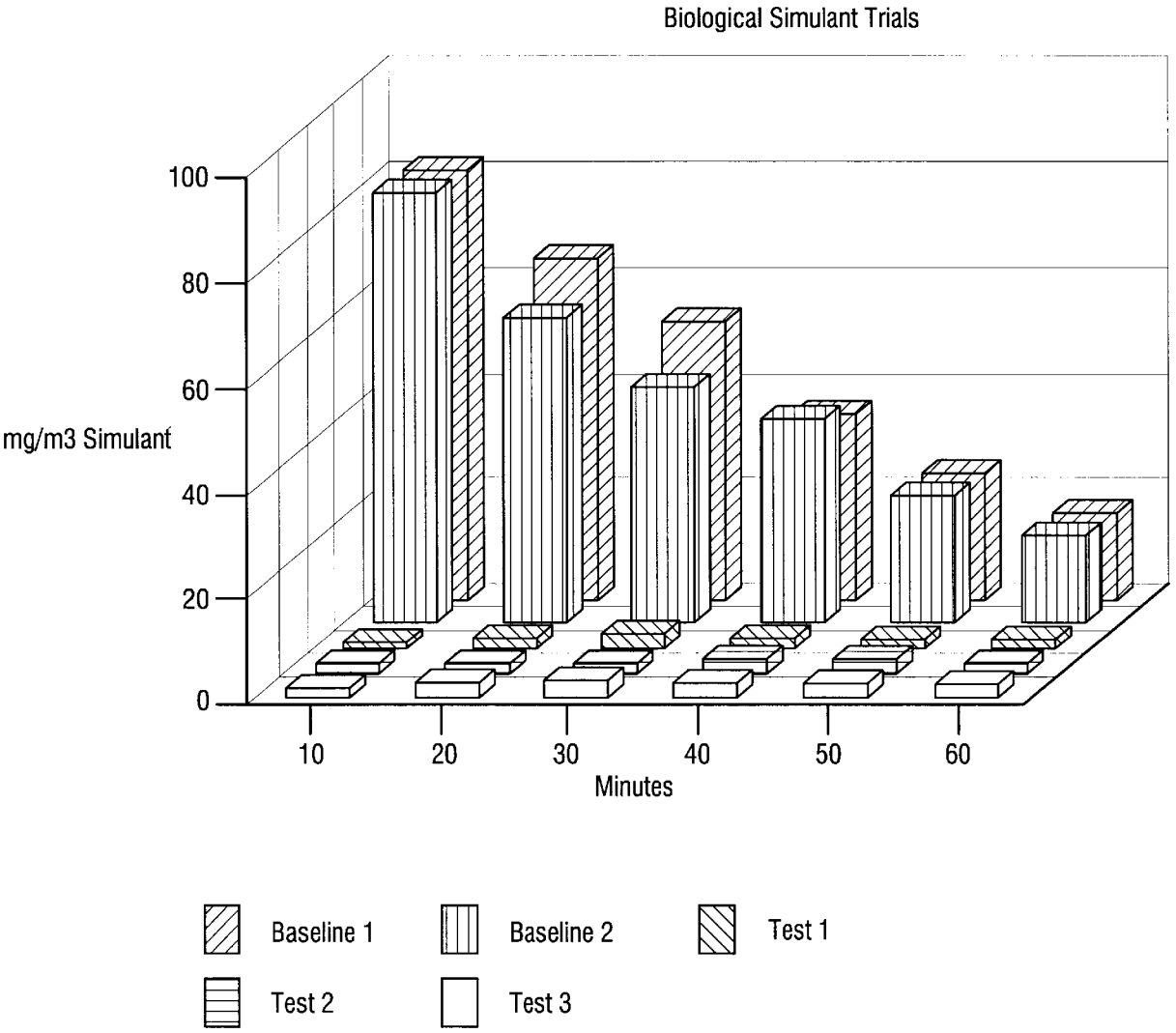

FIG. 3 illustrates the comparison between unmitigated baseline tests and biological tests. The biological simulant formed a fine aerosol that behaved like that of a biological agent. The biological simulant was contained in the order of 95%.

Figure 4:
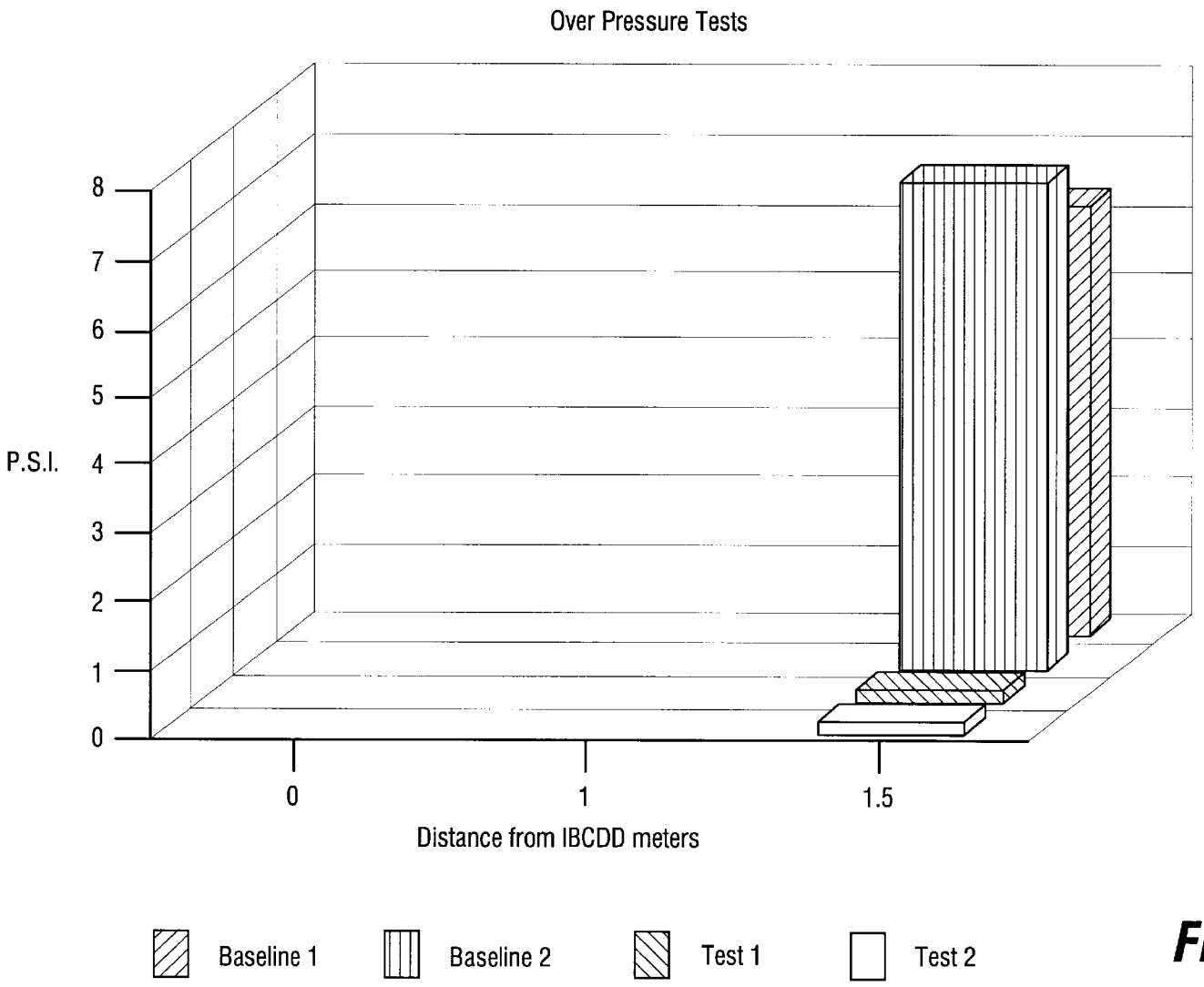

FIG. 4 illustrates the readings obtained by the pressure transducer, placed at 1.5 meters. The foam suppressed simulant tests showed negligible pressure in PSI compared to that observed for the baseline tests.

Example 3

In contrast to the dispersal device used in Example 1, a more energetic fragmenting device was used to disperse agent as well as a selection of less energetic dispersal systems such as high pressure aerosol formation.

Tests were performed using mustard agent simulant, methyl salicylate only. It was felt that chemical contamination represented the worst case scenario and that biological testing would be an unnecessary duplication.

The dispersal devices used were as follows:

Device 1—100 grams C-4 central burster in 1 liter plastic lab bottle containing approximately 950 mL of MS Device 2—120 grams dispersal charge on bottom of 1 liter lab bottle containing 1 liter of MS Device 3MX—steel tool box with batteries, timer, circuit, 500 mL MS simulant (X denotes grams of C-4 i.e. 115, 230, 345 grams)

Device 4—a commercial garden sprayer containing 1 liter MS

The tests were conducted on an open range and in a test chamber measuring 20 ft.×30 ft.×10 ft. (169 $m^3$)

A dome shaped DYNEEMA tent was used as the enclosure structure which was subsequently filled with SILVEX foam (approx. 570 cubic ft.) to suppress the blasts of the various dispersal devices.

Effectiveness of chemical containment was measured using a miniature infra-red gas analyzer (MIRAN™). Further, chemical concentration ranges were determined by collecting simulant aerosols on a Depot Area Air Monitoring System (DAAMS) tube followed by thermal desorption into an HP5890 gas chromatography system equipped with a flame ionization detector. Blast overpressures were determined using ENDEVCO™ piezoresistive pressure transducer and Anderson blast gauges.

Figure 5:
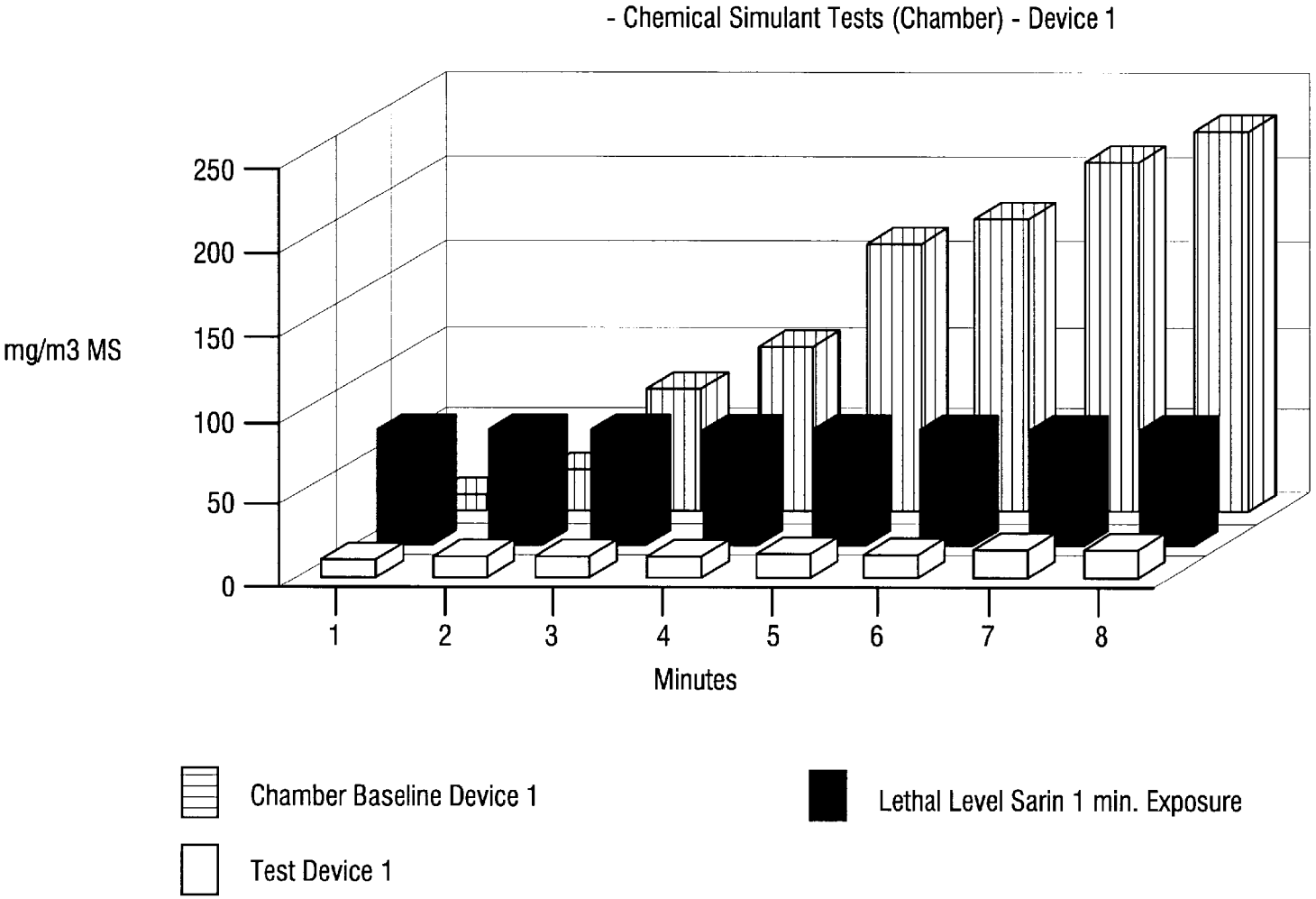
FIGS. 5–11 relate to Example 3.

FIG. 5 depicts the concentrations of simulant in the test chamber after an unmitigated baseline test and a contained test. The lethal level of Sarin after a one minute exposure is shown for reference. A high level of simulant capture was observed.

Figure 6:
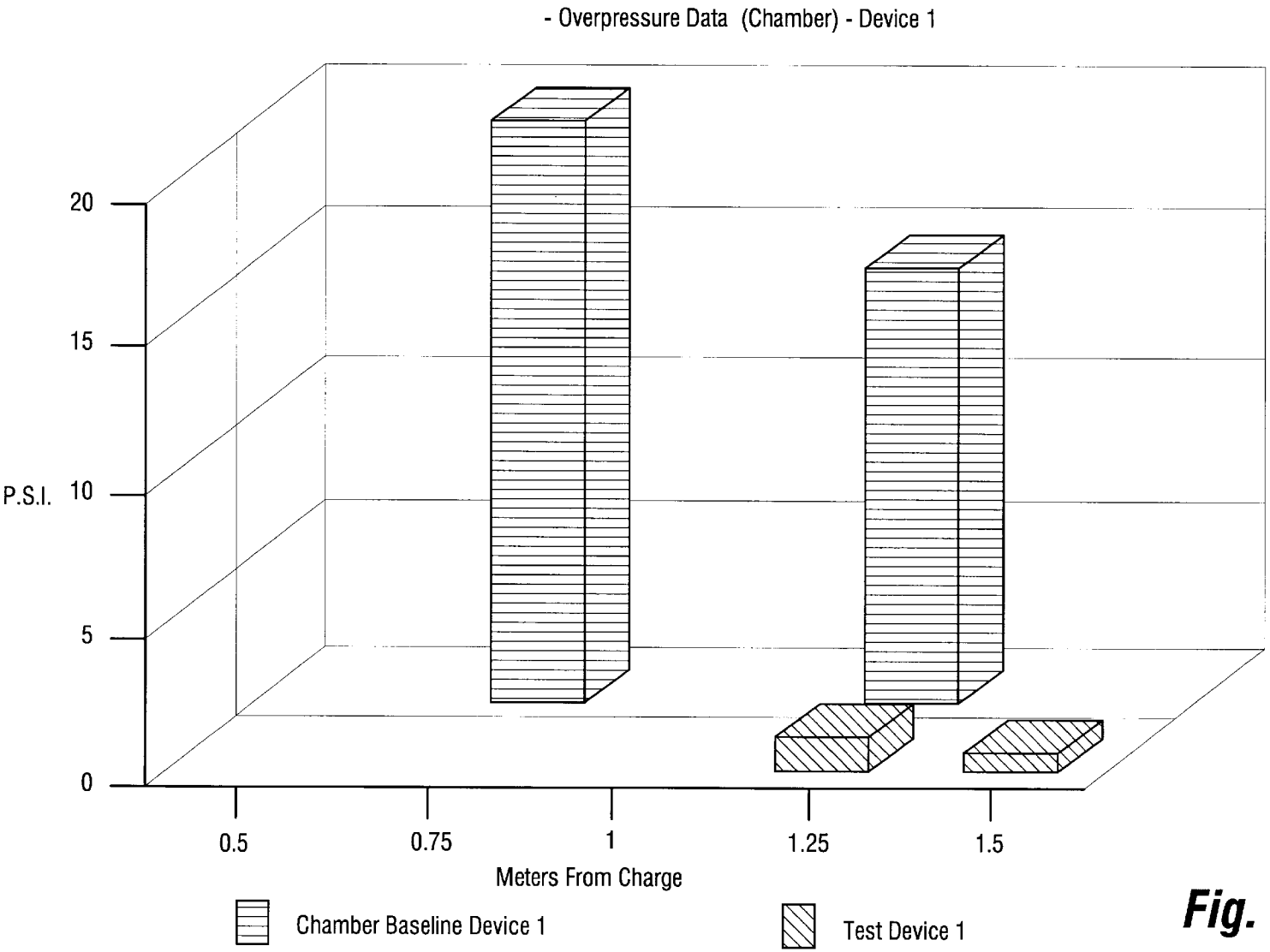

FIG. 6 illustrates the over pressure measurement at the noted distances from the device for both unmitigated and contained tests. Over pressure containment was observed in the order of 90% for contained tests.

Figure 7:
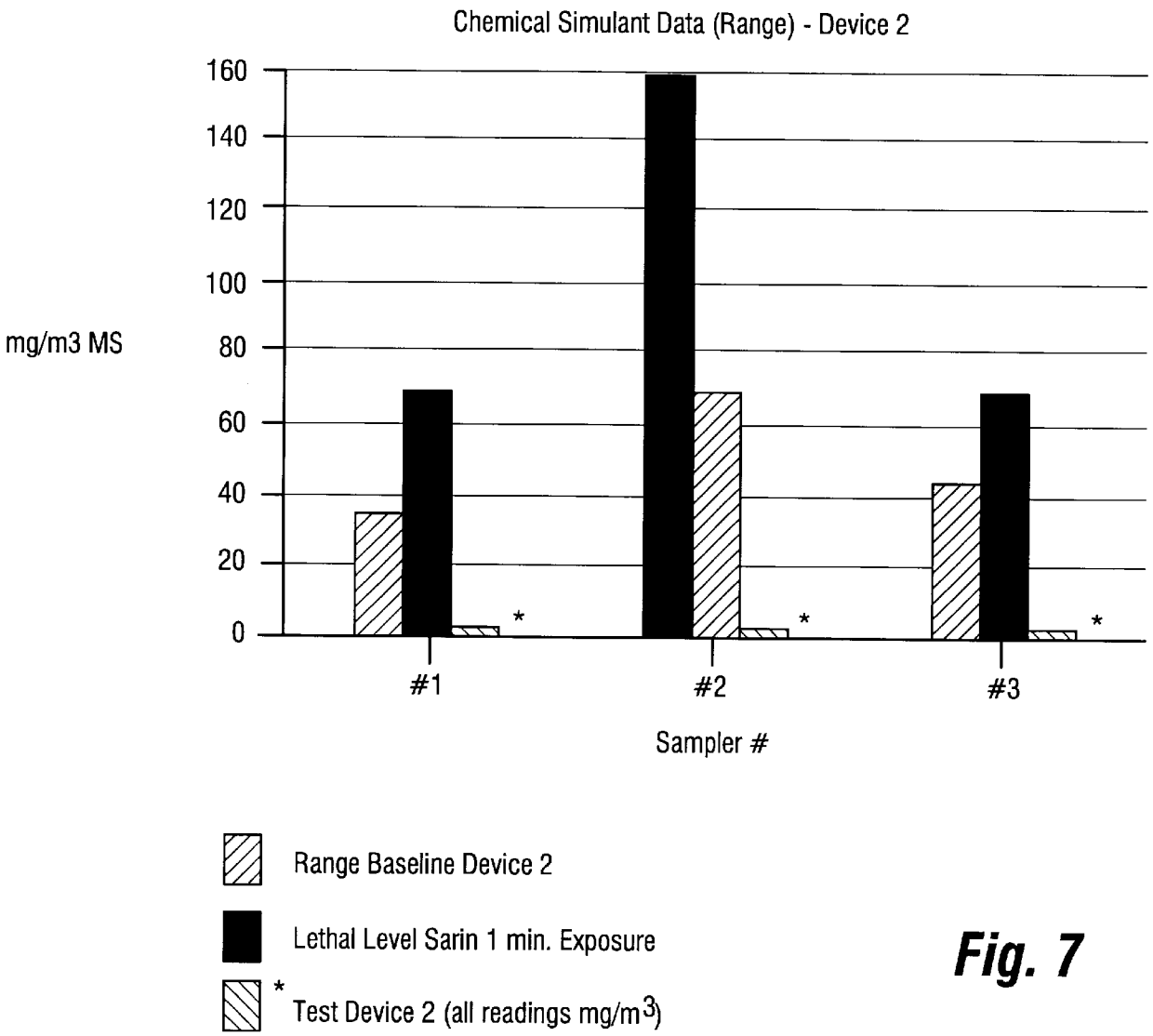
Figure 8:
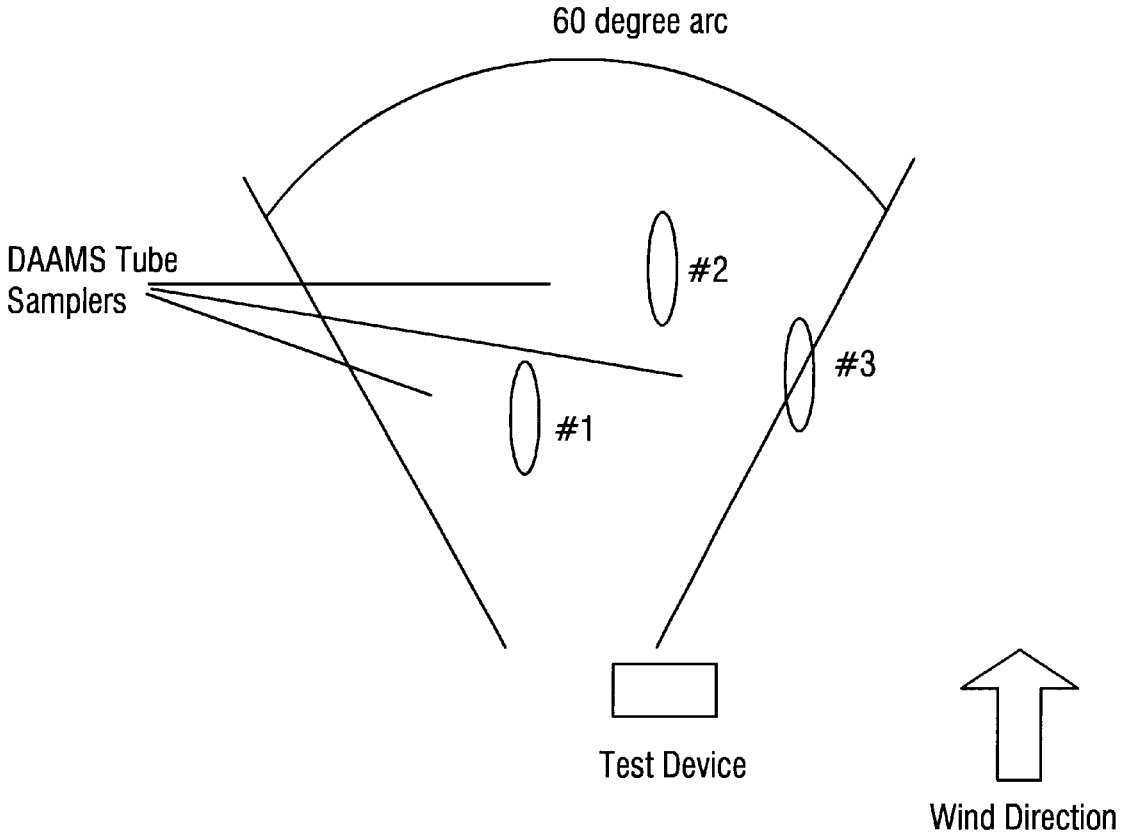

FIG. 7 illustrates the air concentrations of simulant as measured by DAAMS tube samplers in an outdoor trial, their locations further illustrated in FIG. 8.

Figure 9:
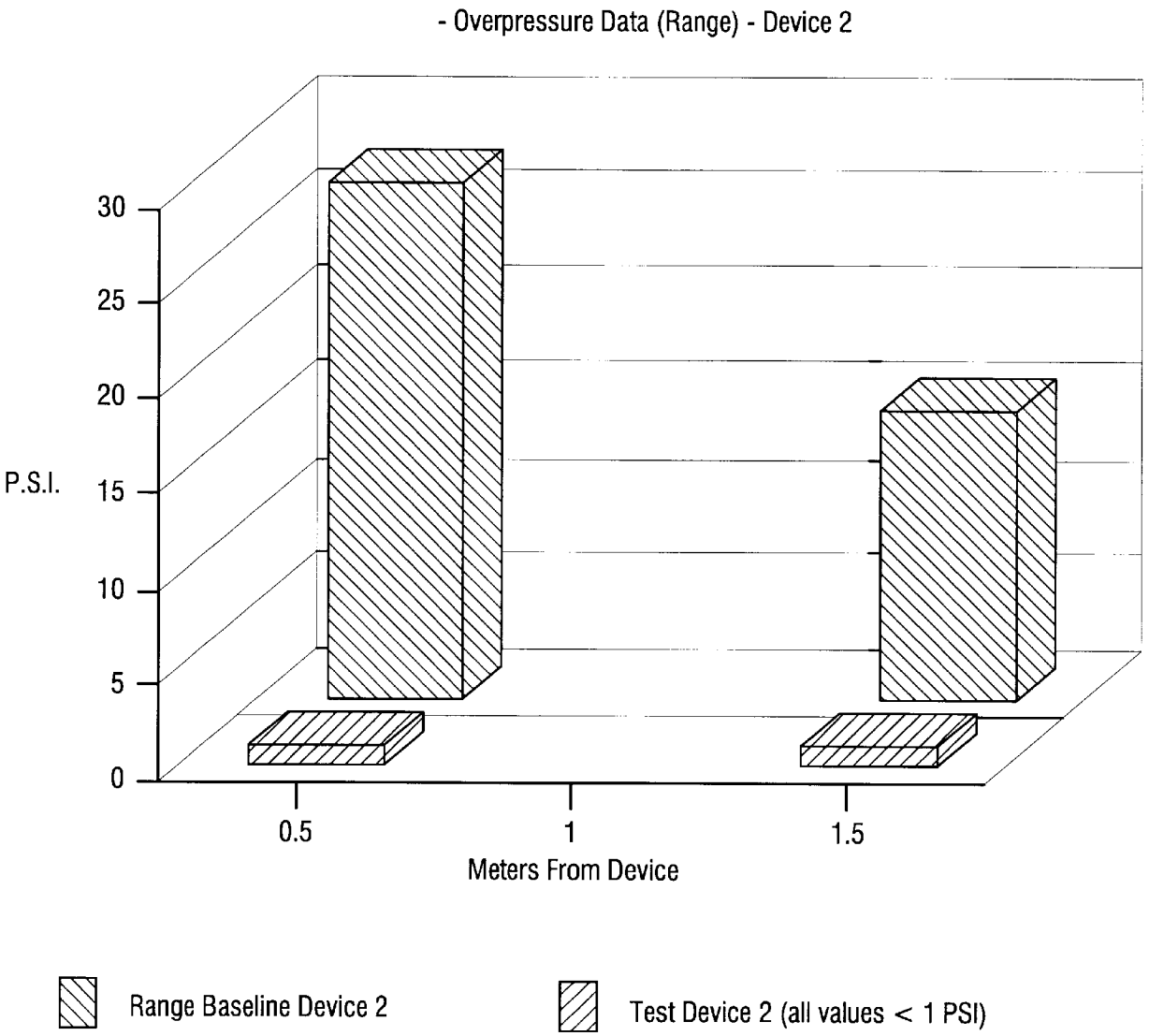

FIG. 9 illustrates the over pressures recorded on two tests, one unmitigated and the other contained. The readings recorded for the contained test were barely measurable i.e. <1 PSI.

Figure 10:
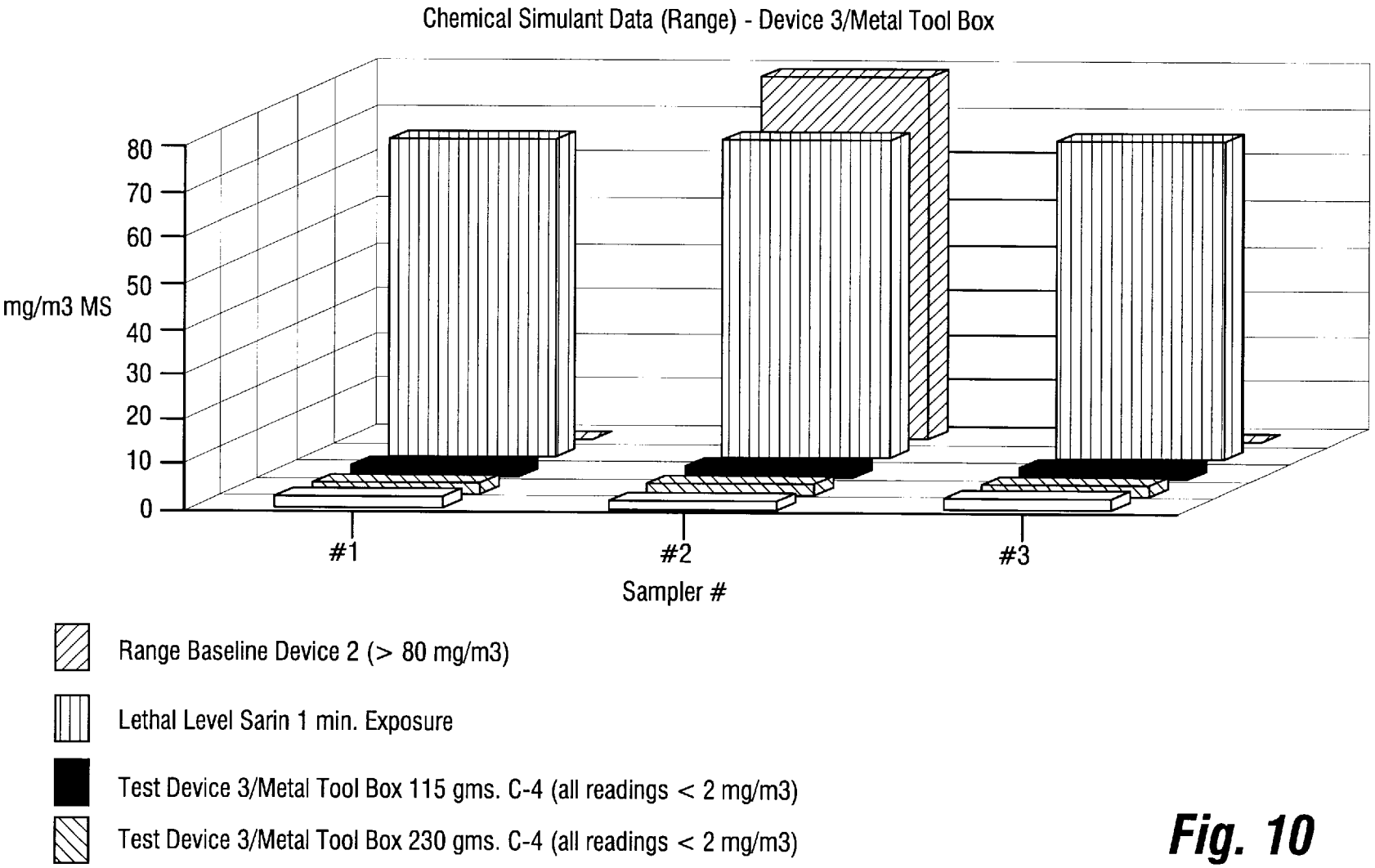
Figure 11:
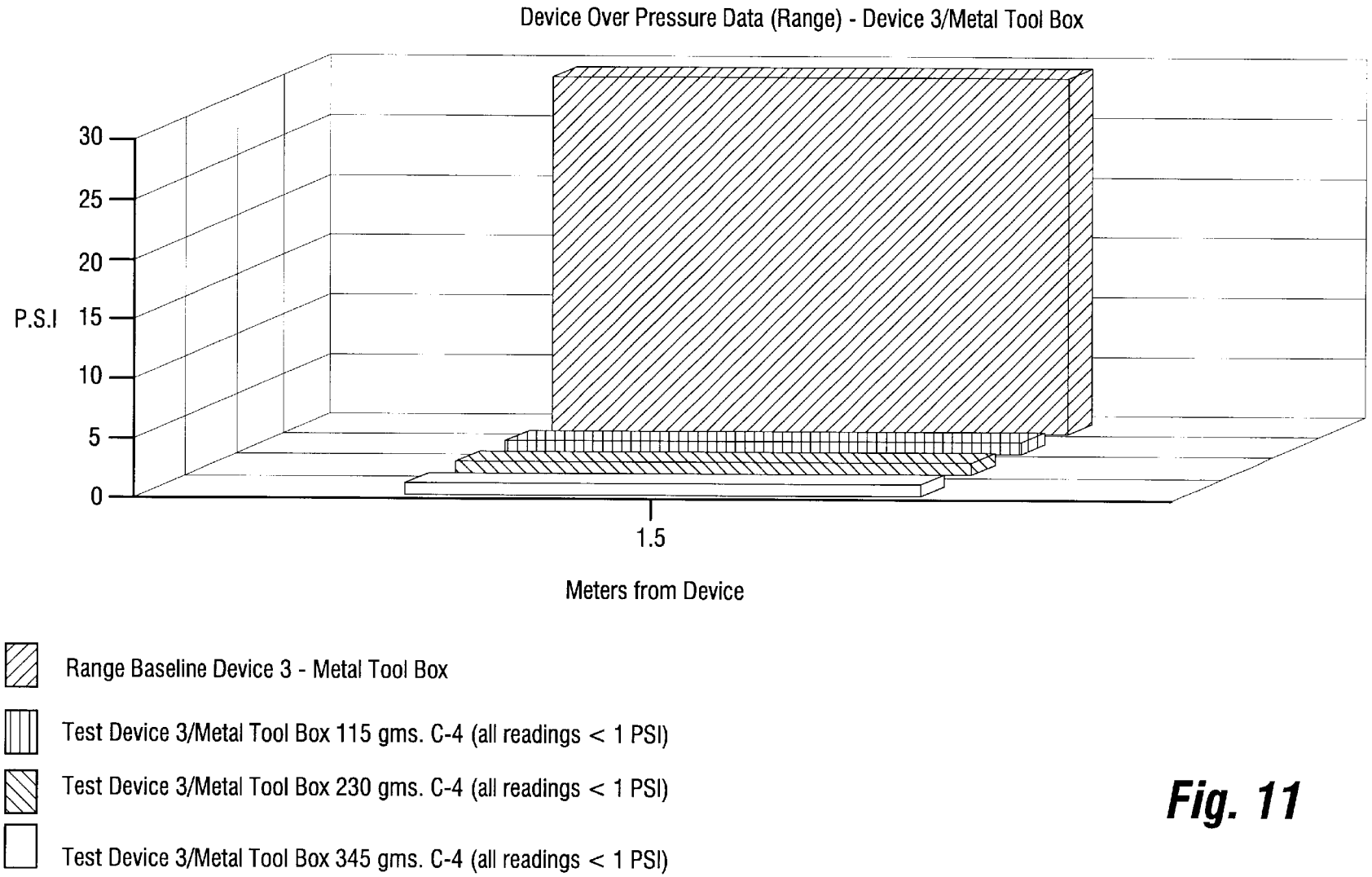

FIG. 10 depicts a baseline unmitigated test and three contained tests, each performed using different explosive amounts. Samplers were located as illustrated in FIG. 8. Containment was realized in excess of 95%. FIG. 11 illustrates the over pressure readings measured at 1.5 meters from the test device for one unmitigated baseline test and three contained tests, each with different explosive loads, as noted. Over pressure readings were diminished by greater than 90% in the contained tests.

Examples 4 and 5

In Examples 4 and 5, staged field tests were conducted to determine the blast suppression decontamination foam formulation's ability to both decontaminate and to suppress a blast.

The presence of G-agent simulant and mustard agent was determined using conventional decontamination monitoring equipment such as Graseby Ionics™ Chemical Agent Monitor or CAM and Chemical Agent Detection Systems Mark II (CADS II) stations, each comprising two CAMs. Further, confirmation of the presence or absence of these agents in air samples was determined using Hapsite™, a portable gas chromatograph/mass spectrometer (GC/MS).

Hapsite was adapted for measurement of chemical agents under ambient test conditions by equipping it with an M213 membrane system capable of more rapid permeation of chemical agents, substituting the standard DB-1 GC capillary column by a DB-5 capillary column, adjusting operating temperature to 80° C. rather than the usual 60° C. used for volatile organic chemicals, and operating the probe inlet line at 45° C. rather than the usual 35° C. The air samples were subjected to a mass spectral analysis alone, as the agents used in the trials were known. This type of analysis does not require any prior chromatographic separation and allows for longer air sampling times. Typically 5 minute samplings were used for the staged testing. Hapsite was also used for full chromatographic separation and mass spectral analysis in the event that the samples demonstrated unexpected results using mass spectral analysis alone.

Example 4

In a first stage, the ability of the CAMS and Hapsite to measure dispersion of the agent simulant, diethyl malonate, was determined. In a second stage, the ability of the blast suppressing decontamination foam formulation to decontaminate mustard painted onto a vehicle surface was tested. In a third and last stage, the ability of the blast suppressing decontamination foam formulation to suppress blasts while containing G-agent simulant and mustard vapor and simultaneously decontaminating the mustard agent, were tested.

Stage 1—Simulant Dispersion Tests

Two dispersal devices, each containing 250 ml of a diethyl malonate (DEM)(propanedioic acid, diethyl ester)/water (50/50 v/v) mixture, were secured to ring stands located in the proximity of target vehicles. One was placed 50 cm above the ground and the other at 75 cm above the ground. Witness cards, containing dyed paper for detecting liquid drops were placed on the ground near the dispersal devices, on the nearby vehicles and on the ground 20 meters downwind of the dispersal devices.

The dispersal devices were activated (functioned). As soon as the site was declared safe from explosive hazard, the witness cards were examined and the site monitored by personnel carrying CAMs. Hapsite was brought to the site to acquire and test air samples at locations near the ring stands, vehicle surfaces, open ground and witness cards.

All witness cards showed evidence of impact from liquid drops. The CAMs produced G-mode readings in the range of 2 to 6 bars indicating mild to heavy contamination with simulant (DEM registers as a G-agent on a CAM). An MS-only survey method, employed on Hapsite, provided data for a total ion chromatogram as shown in FIG. 1, having a single organic chemical with a predominant mass 115 fragment, consistent with diethyl malonate. FIG. 13 shows the results of the mass spectral data analysis indicating that the chemical is indeed diethyl malonate with a probability of 97.5%.

Having determined that the detection equipment was capable of monitoring simulant, the foam formulation was tested to determine its ability to act as a decontaminant in Stage 2.

Stage 2—Vehicle Decontamination Trial

An armored personnel carrier painted with chemical agent resistant coating (CARC) was painted, on one side, with 150 mL mustard. Four CADS II monitoring stations were deployed near the vehicle, three placed downwind. A sample of head-space air was taken from the bottle from which the mustard was taken, using Hapsite and CAM readings were taken near the vehicle prior to the application of the foam formulation. Blast suppressant decontaminating foam was applied to the surface of the vehicle using a hose and spray head assembly, followed by manual scrubbing of the surface with long handled brushes. After a 30 minute waiting period, the foam was washed away with water and the vehicle surface re-surveyed with CAMs. Hapsite was used to take air samples around and downwind the vehicle.

Initial CADS II readings, during the application of mustard to the vehicle showed significant H-mode readings downwind the vehicle. FIG. 14 shows the Hapsite readings prior to application of the foam formulation and FIG. 15 shows the identification of the sample, containing a predominant mass 109 fragment, as being mustard (bis (2-chloroethyl) sulphide), verifying live agent was used for the trials.

Immediately following application of the foam formulation the CADS II and CAM H-mode readings dropped to a zero response. Hapsite air samples acquired around the vehicle did not show any mustard content as shown in FIG. 16.

Clearly the foam formulation was capable of decontaminating the mustard agent, therefore the remaining stage 3 trials were directed towards the foam formulations ability to simultaneously decontaminate and suppress an explosive blast wave.

Stage 3—Blast Suppression/Decontamination Tent Trials

Two separate stage 3 trials were performed, the first using G-agent simulant, diethyl malonate and the second using mustard chemical agent. The ambient temperature during the trials was 6° C.

In each trial a dispersal device was loaded with 250 ml of simulant or agent and secured to a ring stand approximately 50 cm off the ground. Four CADS II monitoring stations were deployed near the site, three in the downwind direction. The stations were activated and allowed to collect and provide data to a remote CPU and computer system. In the case of the simulant trial, the dispersal device was placed inside a commercial tent and then the tent was filled with foamed formulation. In the case of the agent trial, a special tent with an opening in the bottom, but of the same shape and size as the commercial tent, was placed over the dispersal device and then filled with the foamed formulation.

In each case, the device was armed and then functioned. As soon as the area was declared safe from explosive hazard, a survey of the site around the tent was performed by personnel carrying CAMs. Hapsite was used to acquire air samples from around the tent and, in the case of the agent trial, was inserted through an opening in the top of the tent to sample the head space above the foam to detect any mustard contamination. CAM readings of the tent head space were also taken.

In both trials, the tent showed no signs of damage or leakage of foam following activation of the dispersal device.

Regarding the effectiveness of decontamination in the simulant trial, the CADS II and CAM readings taken in close proximity to the tent found no G-mode readings. No evidence of diethyl malonate was found on in the Hapsite reading over a 5 minute period.

Similarly, in the agent trial, CADS II and CAM readings, taken in the proximity of the tent, also showed no H-mode response. No mustard was found in the tent head space air. However, as shown in FIG. 15, the CAM surveys did show a significant H-mode response coupled with a response indicative of a low reference ion peak. This response was exhaustively determined, through both chromatograph and mass spectral analysis (FIGS. 16–19*b*), to have been chlorinated materials, hypothesized to be related to the chlorinated solvents in the original military grade sample of mustard (FIGS. 18–19). It may also be possible that dichloroacetic acid may have been produced from chlorinated alkanes as a result of oxidation, either due to the explosion itself or due to the reaction with the strongly oxidizing decontaminant in the foam formulation.

In both stage 3 trials, it is clear that the foam formulation was capable of both suppressing the blast, as evidenced by the intact tent structure following activation, and capable of decontamination, as evidenced by the lack of G-agent simulant and mustard agent following activation.

Example 5

A second staged trial was performed. Two formulations of blast suppressing/decontamination foam were used. A first CB-decontaminating blast suppressant foam formulation contained 3% active decontaminating ingredient and a second surface decontaminating foam formulation, contained 6% active decontaminating ingredient.

Stage 1—Open Dispersion Trial

A 250 mL Nalgene bottle filled with DEM was fastened to a ring stand at approximately 0.3 m above the ground and 4 m from a small metal building. Witness cards were set out near the device and affixed to the facing surfaces of the building to indicate dispersed liquid spray.

Figure 20:
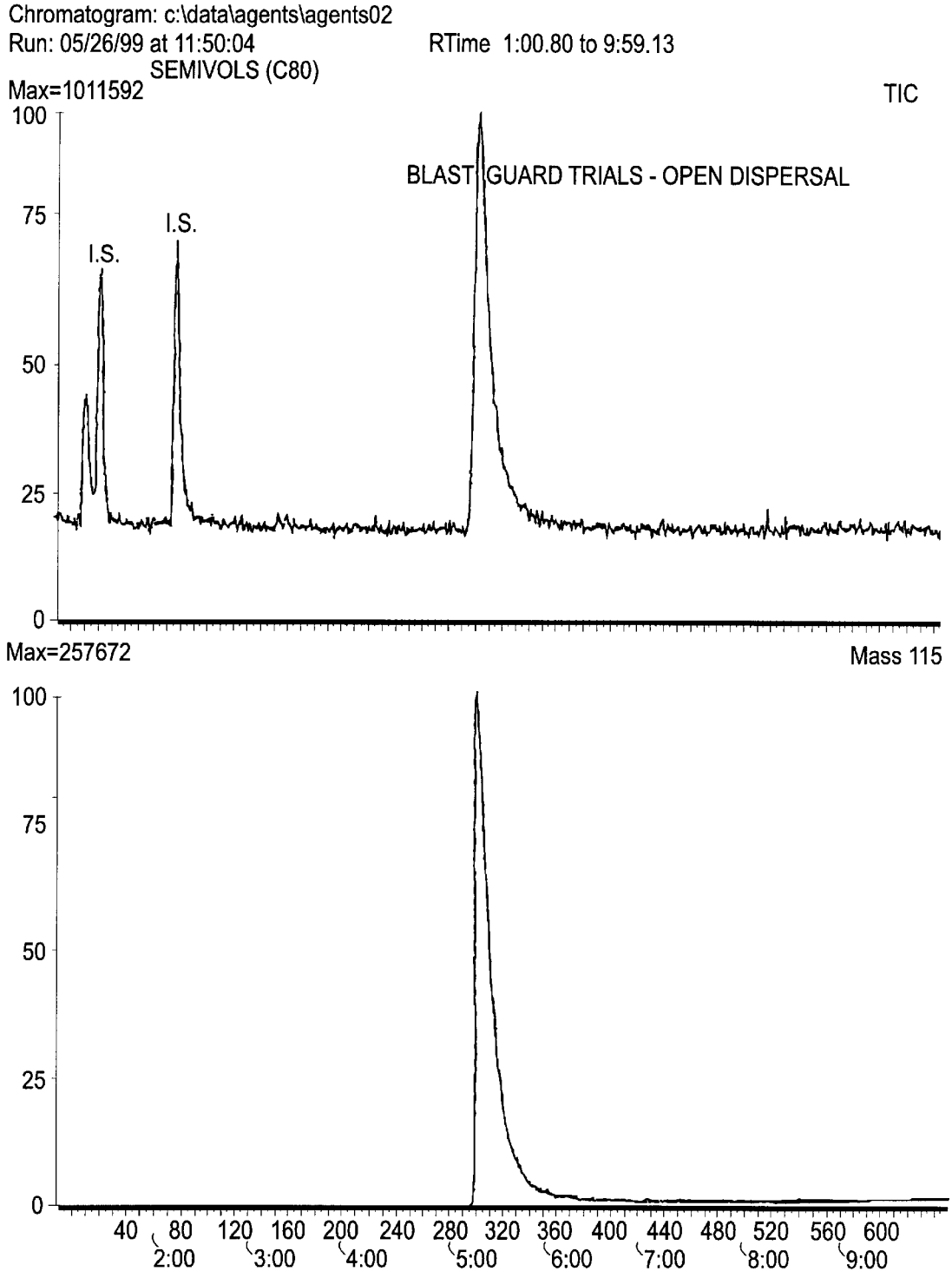
FIGS. 20–23 relate to Example 5.

Following detonation, the witness cards were examined and showed a heavy spray of small droplets for at least 20 m downwind of the device location. The blast produced a loud noise readily heard at least 200 m away. CAMs used to survey the area showed strong G-mode responses 10 minutes after dispersal of the simulant. An air sample acquired by Hapsite showed the sample to contain a high concentration of a single component, subsequently identified as DEM, as shown in the total ion chromatogram of FIG. 20.

Clearly the dispersal equipment used was capable of dispersing simulant over the test site and the instrumentation used to measure the contamination, capable of measuring the G-simulant, DEM.

Stage 2—Vehicle Decontamination

Figure 21:
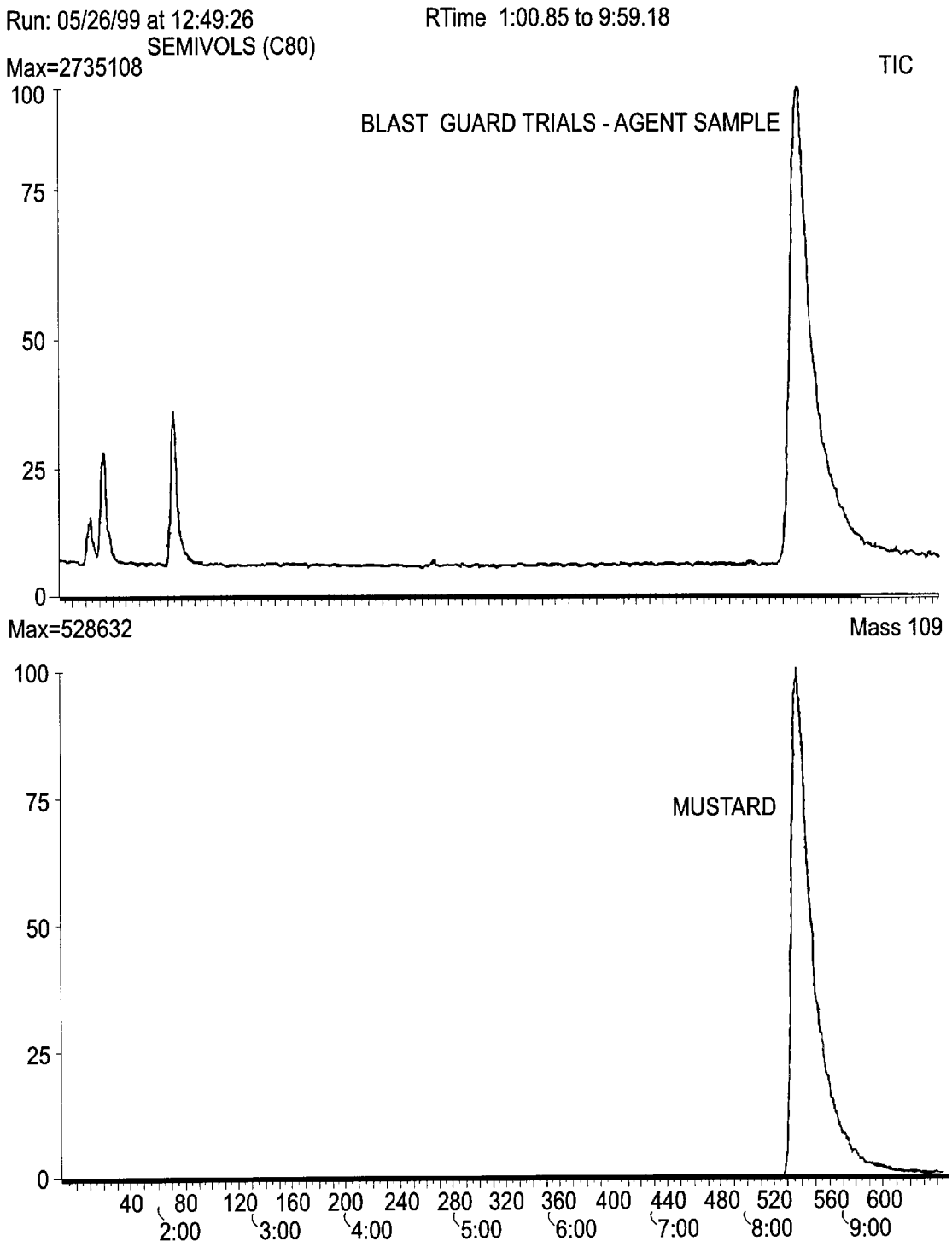

A CARC painted armored personnel carrier (APC) was placed within a plastic-lined containment pit and four CADS stations were deployed in a circular pattern around the pit at a standoff distance of approximately 5 m. Hapsite was used to measure a head-space air sample above a bottle of mustard agent producing a total ion and mass 109 reconstructed ion chromatogram as shown in FIG. 21. This was subsequently verified to be that of mustard, with very few impurities. One side of the APC was painted with approximately 75 mL mustard. All CADS II stations, especially those in the downwind direction, showed an immediate, strong response in the H-mode, indicative of mustard vapor. Surface decontaminating foam (6%) was applied to the vehicle, the vehicle was then scrubbed with long handled brushes and allowed to sit for 15 minutes.

Within one minute of application of the foam, the CADS stations responses returned to baseline, indicating the absence of mustard vapor. CAMs were used to survey the air around the vehicle 10 minutes following foam application and showed no H-mode response. An air sample acquired by Hapsite during the scrubbing process did not show the presence of mustard vapor. After 30 minutes, the vehicle was washed down with water and further CAM surveys were conducted, which verified the absence of mustard vapor.

Stage 3—Blast Suppressant/Decontamination Tent Trials

Two stage 3 trials were performed, one using G-agent simulant (DEM) and one using mustard agent. In both cases, a 250 mL Nalgene bottle equipped with detonation equipment and filled with simulant or agent, was placed on the floor of a steel containment tray, placed inside a 12 ft.×12 ft.×10 ft. wood frame enclosure sealed with polyethylene vapor barrier. Two CAMs and components of a CADS station were located within the enclosure. Further four CADS stations were deployed around the enclosure at a distance of approximately 5 m. All CAMs were set in G-mode for the simulant trial and in H-mode for the mustard trial.

A ballistic tent was placed over the bottle, the tent was filled with CB-decontaminating blast suppressant foam and the bottle was remotely detonated.

In both trials, the tent remained intact and containing all materials. Very little detonation sound was heard outside the tent. The head-space air within the tent and the containment shelter were examined using portable CAMs and Hapsite at 10 minutes after detonation. The temperature of the head space was measured. Further CAM surveys were conducted at 30 minutes post-detonation. Foam was then drained from the tent into the containment tray and CAM surveys conducted to determine the presence of residual simulant or agent.

No response for either simulant or agent was recorded by the CADS stations or CAMs deployed within and about the containment. Temperatures measured in the head-space indicated that the explosive event and decontamination process were exothermic.

Figure 22:
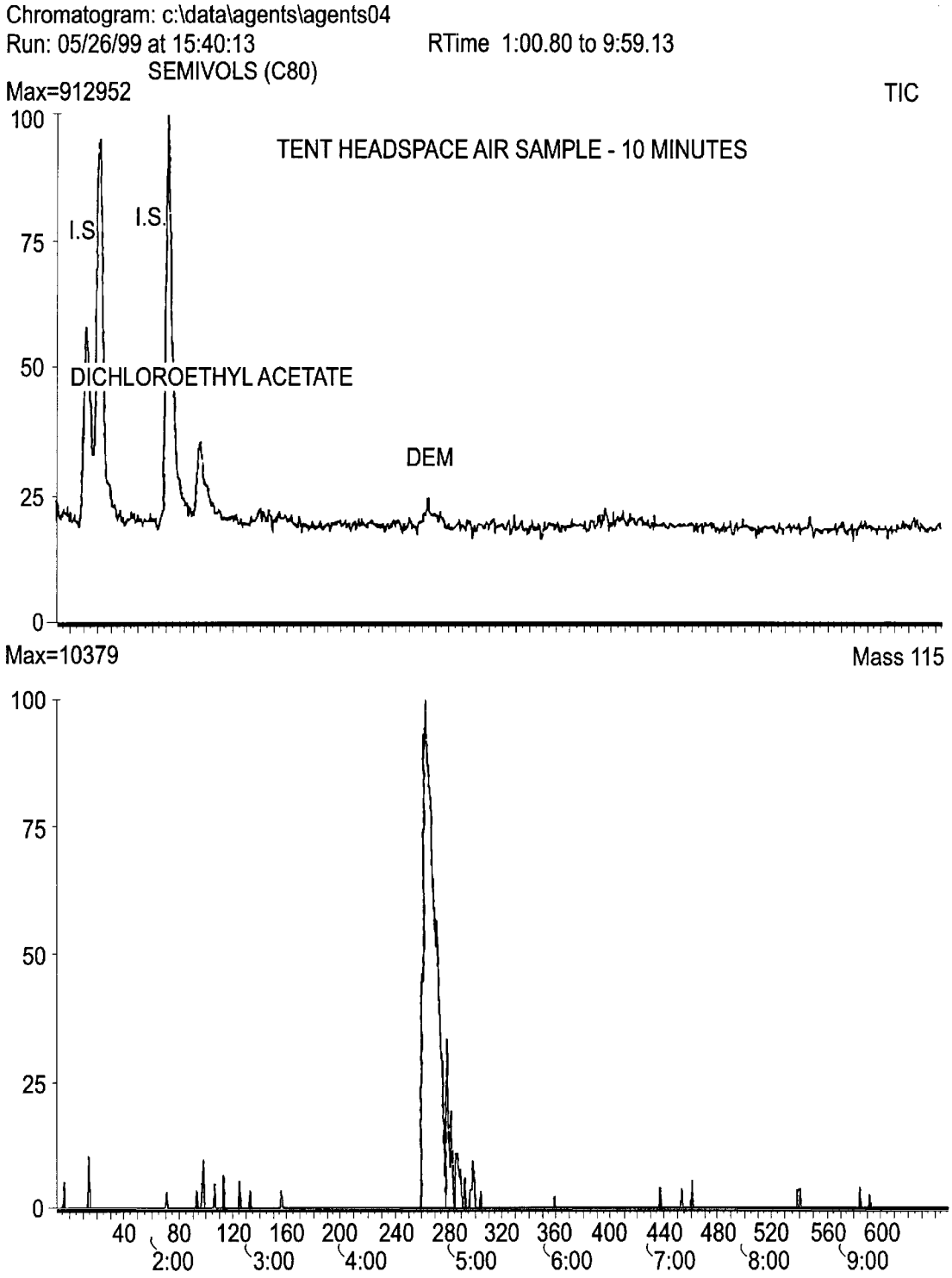
Figure 23:
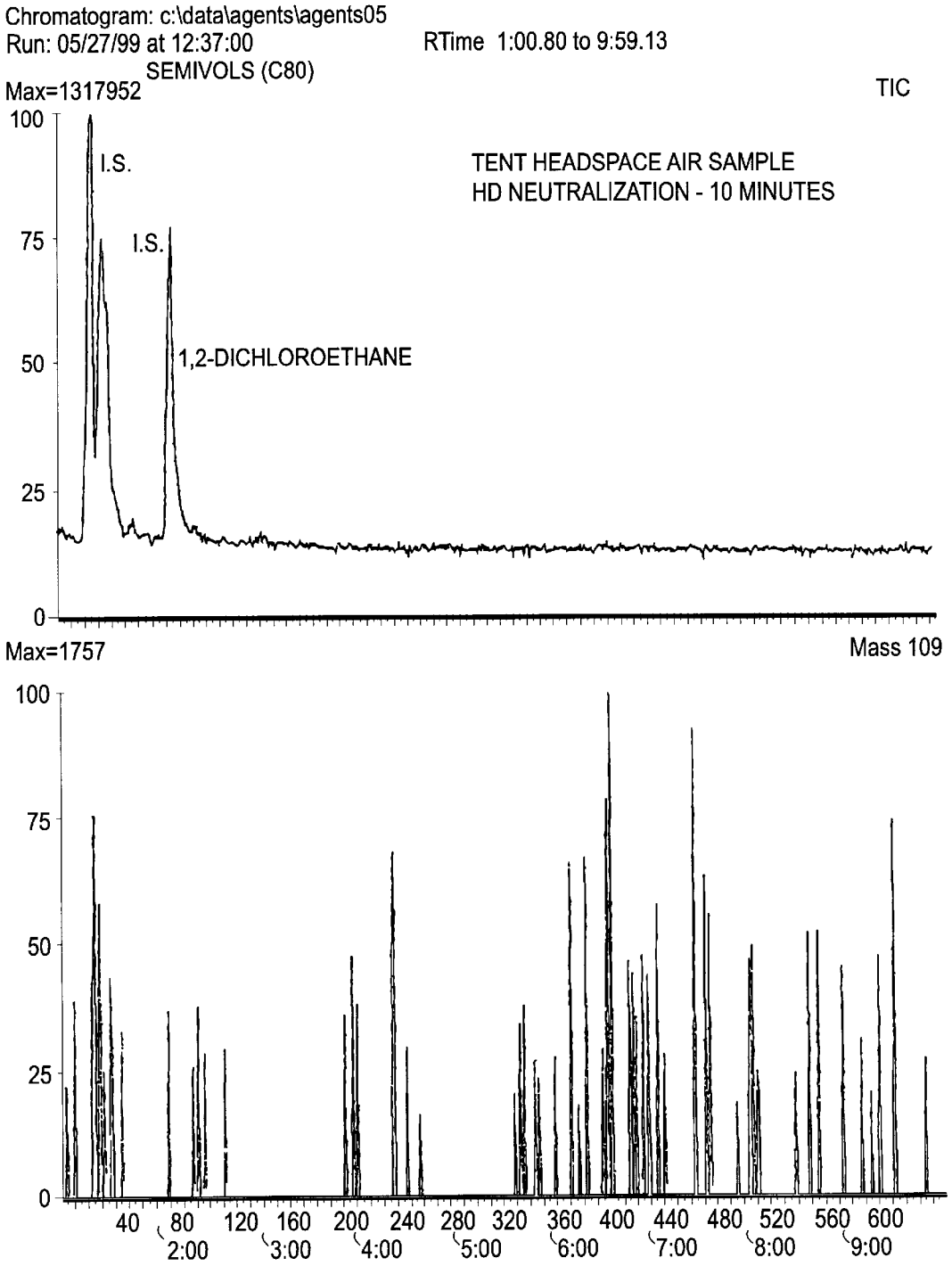

Hapsite GC/MS analysis as shown in FIG. 22 showed a small amount of DEM and dichloroethyl acetate, most likely produced by a reaction between DEM and the chlorinated oxidant in the decontaminant, to be present in the head-space air of the simulant trial. CAM surveys of the released foam materials after 30 minutes showed no evidence of DEM.

CAM surveys in the head space air of the agent trial showed a strong H-mode response which was subsequently proven by Hapsite GC/MS analysis, as shown in FIG. 12, not to be mustard, but to be 1,2-dichloroethane instead. It is thought this compound may be a reaction product of the mustard with the chlorinated oxidant in the decontaminant. Again CAM readings taken over the released foam after 30 minutes show no evidence of mustard vapor.

Clearly the foam formulation is capable of suppressing a blast and decontaminating the CB agents released as a result.

Examples 6–9

Examples 6 through 9 are directed solely at various foam formulation's ability to decontaminate various types of contamination. These include, chemical warfare agents of the G and V classes, mustard agent, biological spore-forming warfare agents and radioactive particulates.

Further, in each of Examples 6–8, quantitative analyses for residual agents were performed on a high pressure liquid chromatography (HPLC) system for separation of the reaction components, equipped either with a HPLC-UV detector in series with a commercially available dual flame gas chromatographic flame photometric detector (FPD) from Varian Associates, or, where possible, on a Hewlett-Packard 1100 LC-MS system equipped with a diode-array UV-VIS spectrophotometer and mass selective detector (MSD). The water used in the reactions, prepared solutions, and in the HPLC was distilled and deionized. The formulation for the surfactant/foam was first warmed to 32° C. to ensure homogeneity. CB agents and simulant DFP were provided by the Canadian Single Small Scale Facility at the Canadian Defence Research Establishment Suffield (DRES) in southern Alberta, Canada and Aldrich Chemical Company, respectively. GB stock calibration solution was prepared by weight in acetonitrile (AcCN) and several dilutions were prepared ranging from 25 to 900 ng/$\mu$L for calibration of the FPD, UV, and MSD responses. Stock solutions of the other CW agents were prepared volumetrically in AcCN and similarly diluted for calibration.

Unless otherwise specified, in a typical experiment, samples were prepared in 2.0 mL autosampler vials. The first addition was a water solution containing the foamer and, if necessary, the co-solvent. This was followed by buffer concentrate, then the decontaminant concentrate which had been separately prepared by adding the active ingredient, anhydrous sodium dichloroisocyanuric acid (SD), to water and heating to 29° C. with stirring for 15–30 minutes. Finally, the CB agent was added defining time zero, and aliquots, at noted elapsed times, were directly injected into the LC. The temperature of the vial holder was maintained at 25.0° C. and a mini stirbar in the vial mixed the components. Fresh samples were prepared for each FPD analysis to obtain residual agent concentration profiles over time and these same solutions were subsequently analyzed by LC-MS.

Example 6

Having reference also to FIG. 24, the effectiveness of several decontaminant formulations against selected G-type nerve gases GB, GA and GD and mustard gas, HD, was determined. The formulations tested consisted of an active ingredient, a foamer, an inorganic buffer mixture and, optionally, co-solvent, in excess of that already present in the foamer mixture. The co-solvent values in FIG. 24 represent added co-solvent and that contained in the foamer.

Three decontamination formulations were assessed for effectiveness against typical G-nerve agents; the mildest formulation, using 3% w/w SD, a ⅔ strength buffer, and 1.3% w/w foamer; an intermediate strength formulation with 6% w/w SD, full strength buffer, 4.6% w/w foamer and an additional 6.9% w/w to 7.8% w/w co-solvent, and a full strength formulation with 9% w/w SD, full strength buffer, 4.8% w/w foamer and 6.9% w/w additional co-solvent. Although anhydrous SD was used in preparation of the solution, percentages are quoted in terms of the equivalent amount of dihydrate. Percentages (w/w) quoted for foamer represent undiluted double-strength foamer which has 45.5% surfactant.

In order to standardize concentrations between experiments, the effectiveness was calculated as a percentage of residual agent.

Using 0.29% w/w GB, there was no evidence of residual agent in any of the LC-FPD or LC-MS analyses for the mildest and intermediate strength formulations (3% w/w and 6% w/w SD). GB was destroyed in each case before the first sample could be taken (0.43 and 1.13 minutes respectively). For the most potent formulation (9% w/w SD), only LC-FPD analysis was performed at 1.78 minutes elapsed time and no agent was detected indicating complete destruction of the agent within 1.78 minutes.

Using 0.29% w/w GA, only the mildest and intermediate strength formulations (3% w/w and 6% w/w SD) were evaluated. The mildest formulation was tested in two separate experiments. In the first, containing ~1.6% w/w foamer, LC-FPD analysis indicated that GA was destroyed within 1.33 minutes. In the second, containing ~1.8% w/w foamer, there was no evidence of GA in 1.07 minutes elapsed time (LC-FPD) or 3.43 minutes (LC-MS). For the intermediate strength formulation containing an additional 7.5% w/w co-solvent, there was no evidence of GA in 1.07 minutes elapsed time by LC-FPD or 3.35 minutes by LC-MS.

Using 0.29% GD, again only the mildest and intermediate strength formulations were each evaluated. The full strength formulation was not tested due to the success with the two milder formulations. The mildest formulation was tested and, in contrast to the other two G-agents examined, small amounts of residual GD appeared to be observed for the shortest reaction time sample. Specifically, as analyzed by LC-FPD, 5.0% residual agent appeared to be present at 1.07 minutes and 0.5% appeared to remain at 4.77 minutes, and the agent was completely gone by 10 minutes, as determined by LC-MS analysis. Similar results were observed using the intermediate solution containing 7.8% additional co-solvent. Complete LC-MS characterization of the peak eluting at GD in a stock solution of GD suggests that a trace of a GD-related impurity, methylpinacolylmethylphosphonate also eluted at this point, possibly contributing to the residual peak observed at short reaction times in HPLC-FP. Thus, although GD appears to be more difficult to destroy than GB or GA, the mildest formulation is still very effective against GD within acceptable time limits.

Using 0.27% w/w HD, again due to their success, only the mildest and intermediate strength formulations were evaluated. The mildest formulation was tested for effectiveness against HD in three separate tests. In the first test, there was no evidence of residual HD after 2.67 or 4.92 minutes (reaction solutions had to be mixed more vigorously than the other agents due to limited solubility of HD so earlier sampling was not possible). In the second test, no residual agent was detected after 3.0 or 62.1 minutes, however 6.2% of residual HD appeared to be present after 5.4 minutes assuming that the eluting peak was indeed HD. As a confirmatory test, an third experiment was performed and no HD was detected after 3.65 or 4.97 minutes.

It is therefore concluded that even the mildest formulation, and least likely to affect a foam's blast suppression capability, is completely effective against this level of HD in less than 2.7 minutes.

The intermediate formulation also tested for effectiveness against HD and demonstrated no residual HD after 2.47, 5.27, or 53.3 minutes. Verification by LC-MS could not be performed as HD cannot be detected using positive API-ES under these conditions.

Example 7

Having reference also to FIG. 25, the effectiveness of several formulations against the nerve agent VX was determined. Samples were prepared as described in Example 6. Two decontaminant formulations were assessed for effectiveness against VX-nerve agent: the mildest formulation (MILD) with 3% w/w SD, 2/3 strength buffer, and 1.3% w/w foamer, and the full strength formulation (FS*) with 9% w/w SD, full strength buffer, 4.8% w/w foamer and 6.9% w/w additional co-solvent. As with Example 6, percentages quoted for foamer represent undiluted double-strength foamer.

Control formulations were also examined. These included a formulation containing only full strength buffer and foamer (Buffer/Surf) and a formulation containing all ingredients of the full strength decontaminant but without active ingredient (FS*wo/SD).

In order to standardize concentrations between experiments, effectiveness was calculated as percentage of residual agent. In addition, an authentic sample of a known potential toxic product (Toxic Product), of hydrolysis of VX, S-(2-diisopropylaminoethyl) methylphosphonothioic acid was synthesized and characterized by LC-MS to be used as an indicator of unsuccessful detoxification of VX. All reaction mixtures were examined for the presence of this compound; the presence of significant quantities would be sufficient evidence to disallow the formulation as a possible decontaminant candidate. The results are summarized in FIG. 25.

In the first evaluation, the control formulation of buffer and foamer (Buffer/Surf) was tested at a low concentration of VX (4:L/ml). After six days, 42% of the VX remained and toxic product in significant quantity was detected. The control formulation of full strength formulation without active ingredient (FS*wo/SD) was tested against a concentration of 12:L/ml of VX. Again, significant quantities of VX and toxic product were found at 125 minutes and 6 days. Additionally, there was evidence of VX droplets in the solution at 125 minutes indicating that saturation levels of VX were present in solution and that removal of VX from the system was slow. When full strength formulation with SD was employed in excess (18.2:1 active species/VX), all VX was destroyed in less than 7 minutes with no evidence of toxic product.

A more extensive examination of the temporal effectiveness of the mildest formulation was undertaken in which the stoichiometric ratios of concentrations of VX to active chlorine present in solution were varied. For the lowest ratio (~6:1), effective decontamination of VX was not achieved although only small traces of toxic product were observed. On the other hand, if the ratio was ~16–18:1, complete decontamination without significant production of toxic product was achieved. As shown in FIG. 25, the mildest formulation at a ratio of 18.2:1 is completely effective in less than eleven minutes. A similar formulation reacting at a ratio of 29:1 resulted in similar effectiveness, however this is most likely due to the fact that the trace recorded by the LC-MS is at its detection limit using this procedure.

An analysis of the mild formulation without added VX did not register any response for VX eliminating the possibility of a false positive VX result due to the formulation itself.

In conclusion, even the mildest formulation is highly effective against VX provided that the ratio of reactant to agent is maintained over at least 17:1. This finding is in accordance with statements made in Y-C Yang, J. A. Baker, and J. R. Ward, Chem Rev., 1992, 92, p1731, in which the authors state that greater than 10 moles of active chlorine are required to oxidize 1 mole of VX.

Example 8

The effectiveness of foam phase-detoxification of anthrax spores was determined. A suspension of *Bacillus anthracis* (Ames strain) was heat shocked to kill the vegetative cells, leaving only the viable spores. Small metal coupons, painted as per in-service military vehicles, were cleaned with ethanol wipes and sterilised by autoclaving. Each coupon to be used was spotted with 200 $\mu$L spore suspension, distributed over the surface of the coupon as 60–70 small droplets and allowed to dry overnight in a biosafety cabinet in a Level 3 Biocontainment laboratory.

Two trials were performed on two separate days using freshly prepared foam formulations. Each trial used two of these coupons, one to test the decontamination formulation and one to act as a control. Each coupon was placed in a 100 mm petri dish, supported to keep it from coming in contact with the bottom of the dish and covered with either the decontamination foam of the present invention or a control foam not containing the decontaminant active ingredients. The lid of the petri dish was replaced and twisted to ensure that the foam contacted the entire coupon. After 30 minutes each coupon was removed from the petri dish using forceps, rinsed with sterile PBS, then swabbed twice over its entire surface with a sterile sampling swab. The swab was placed in 5 ml of Heart Infusion broth and vortexed.

In both trials, 200 $\mu$L of neat broth from the decontamination foam-treated coupon and 200 $\mu$l of a $1\times10^{-4}$ dilution (in PBS) of the broth from the control foam-treated coupon were plated onto each of four Blood Agar plates. The plates were incubated overnight at 37° C. and the Colony Forming Units (CFU) observed the following day, are given in Table II. The Control foam results are shown multiplied by $10^4$ to adjust for the $10^{-4}$ dilution.

Trial 1 and Trial 2 indicate, respectively, that, on average, only 0.0108% and 0.00109% of the original material on the decontamination foam-treated coupons remained viable, translating into a 99.989% and 99.999% kill for simple contact with the decontamination foam for a period of 30 minutes.

TABLE II

Data from Anthrax Spore Decontamination Trials.

| | Colony Counts | | | |
|---|---|---|---|---|
| Experiment | Plate 1 | Plate 2 | Plate 3 | Plate 4 |
| Trial 1 - Decon foam | 33 | 26 | 28 | 21 |
| Trial 1 - Control foam | $22\times10^4$ | $22\times10^4$ | $29\times10^4$ | $28\times10^4$ |
| Trial 2 - Decon foam | 13 | 10 | 5 | 3 |
| Trial 2 - Control foam | $66\times10^4$ | $72\times10^4$ | $68\times10^4$ | $78\times10^4$ |

Example 9

Figure 26:
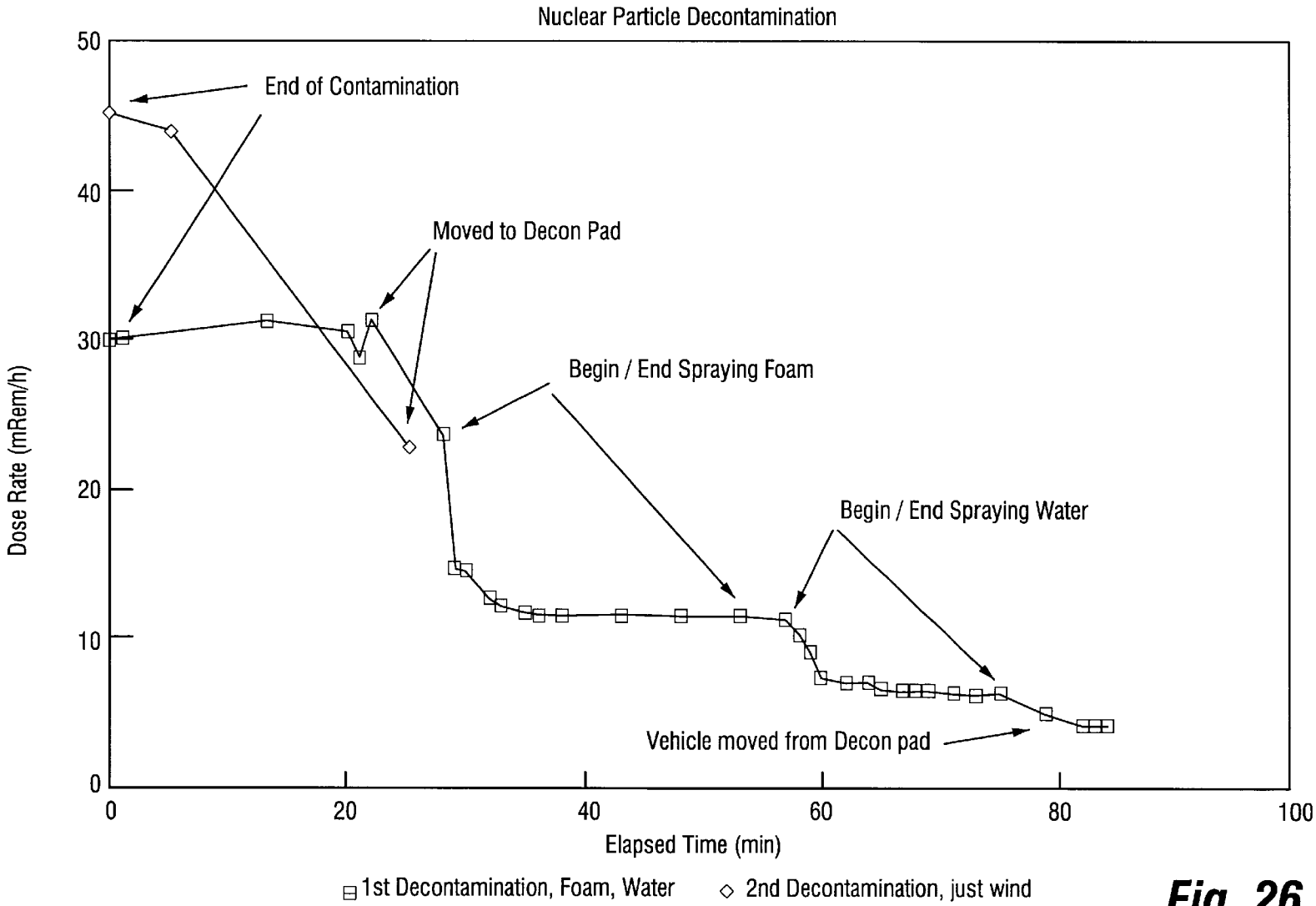
FIG. 26 is a graph illustrating the effectiveness of the foaming agent by itself to effect decontamination of radioactive dusts from the exterior surface of an armored vehicle.

Having reference to FIG. 26, the effectiveness of the one variant of the foaming agent by itself to effect decontamination of radioactive dusts from the exterior surface of an armored vehicle was demonstrated. The vehicle, a French AMX-10 Armored Personnel Carrier, was contaminated by spraying the exterior with $^{140}$La particles (100–200 $\mu$m) to simulate surface contamination as might be caused by driving across contaminated dusty terrain. Decontamination formulation using Silv-Ex foamer was sprayed over the surface of the vehicle using a powered pressure washer fixed with an air induction foam nozzle of the type normally used in applying fire-fighting foams. Subsequent to the application of decontaminant, the vehicle was towed to a sensing frame where radiation measurements on the exterior could be made. In FIG. 15, the radiation level measured inside the vehicle in the first trial was observed to be in the order of 30 mRem/hr. After towing to the decontamination site and commencing application, the radiation level was observed to drop significantly (to approximately 11 mRem/hr) presumably due to foam layers dropping off the sides of the vehicle during the application stage. The radiation level flattened off over the course of the decontamination probably due to residual particles remaining on the vehicle in areas where the foam could not drop off (top, crevices) readily. On commencement of rinsing of the vehicle with water, the radiation level dropped even further (to approx. 6 mRem/hr) presumably due to flushing off some of the remaining radioactive particles. A map of the radiation emitted from the exterior surface of the vehicle as sampled by a frame of 80 probes confirmed that the radiation had been significantly reduced by decontamination using Silv-Ex-based decontamination foam.

In a subsequent trial, the same vehicle was contaminated to a level of approximately 45 mRem/hr. During movement of the contaminated vehicle to the site of decontamination, significant loss in the level of radioactivity was observed. The loss was such that the trial was terminated. It was apparent that the exterior surface, having been previously cleaned in an earlier trial, did not retain radioactive particles sprayed onto it. In other words the surface had been degreased and dust adherence had been significantly decreased, suggesting an additional benefit to the use of the formulation.

In a related examination in which paint panels were contaminated and subsequently decontaminated by dry scrubbing, the standard approach for decontamination of radioactive particulate matter was observed to attain a low level of 0.55 mRem/hr whereas decontamination with Silv-Ex-based decontamination foam reduced the radiation to a level of 0.33 mRem/hr after one application and 0.22 mRem/hr after a second decontaminant application, both of which surpass the standard approach for addressing this hazard.

The embodiments of the invention for which an exclusive property or privilege is claimed are as follows:

1. A method for dispersal suppression from an explosive CB contamination device comprising the steps of:

(a) surrounding the explosive contamination device with a containment structure;

(b) preparing a foamer from a surfactant, a co-solvent selected from the group consisting of polypropylene glycol, polyethylene glycol, and derivatives and mixtures thereof, and a foam stabilizer;

(c) preparing a decontamination formulation from a chloroisocyanuric acid salt, and a buffer to maintain said formulation at a pH from about 11 to about 8.5;

(d) preparing a mixture of the foamer and decontamination formulation in water;

(e) foaming the mixture to produce a foamed mixture; and (f) filling the containment structure with the foamed mixture.

2. The method of claim 1, wherein said chloroisocyanuric acid salt is selected from the group consisting of an alkali metal of monochloroisocyanuric acid, dichloroisocyanuric acid, and a combination thereof with cyanuric acid.

3. The method of claim 2, wherein said alkali metal of dichloroisocyanuric acid is sodium dichloroisocyanurate.

4. The method of claim 1, wherein said buffer fails over time, allowing the pH to fall to a pH about 8.5.

5. The method of claim 4, wherein the buffer maintains the pH of the formulation above 8.5 for at least 30 minutes.

6. The method of claim 1, wherein polypropylene glycol has the chemical formula $R_1$—$(OCH(CH_3)CH_2)_n$—$OR_2$, where $R_1$ and $R_2$ are independently H, an alkyl, or an ester group and n>1.

7. The method of claim 1, wherein said alkyl group representing $R_1$ or $R_2$ is a methyl, ethyl, propyl, or butyl group or a mixture thereof.

8. The method of claim 1, wherein at least one of said $R_1$ or $R_2$ is hydrogen.

9. The method of claim 1, wherein said both $R_1$ and $R_2$ are hydrogens.

10. The method of claim 1, wherein said polypropylene glycol derivative is a partially etherified polypropylene glycol.

11. The method of claim 10, wherein said partially etherified polypropylene glycol has the formulae $R_1$—$(OCH(CH_3)CH_2)_n$—$OR_2$, where one of $R_1$ or $R_2$ is independently H, or an alkyl group and $n \geqq 1$.

12. The method of claim 11, wherein said alkyl representing $R_1$ or $R_2$ is a methyl, ethyl, propyl, butyl group or a mixture thereof.

13. The method of claim 11, wherein at least one of said $R_1$ or $R_2$ is hydrogen.

14. The method of claim 1, wherein lithium hypochlorite is present in amounts in the range of from about 5 to about 10% by weight of the dichloroisocyanuric acid salt.

15. A process for neutralizing an explosive CB contamination device comprising:

(a) producing an aerated foam formed from a formulation in water comprising a surfactant, a co-solvent selected from the group consisting of polypropylene glycol, polyethylene glycol, and derivatives and mixtures thereof, a foam stabilizer, chloroisocyanuric acid salts, and a buffer to maintain said formulation at a pH from about 11 to about 8.5; and (b) surrounding the explosive CB contamination device with the aerated foam.

16. The process of claim 15 further comprising surrounding the explosive CB contamination device with a containment structure and filling the structure with the aerated foam.

17. In combination, a system for dispersal suppression of an explosive CB contamination device comprising:

(a) a containment structure for surrounding the explosive contamination device; and (b) aerated foam contained within the structure being formed from a decontamination formulation in water comprising a surfactant, a foam stabilizer, a solvent selected from the group consisting of polypropylene glycol, polyethylene glycol, and derivatives and mixtures thereof, chloroisocyanuric acid, and a buffer to maintain said formulation at a pH from about 11 to about 8.5.

18. The system of claim 17 wherein (a) the foamer comprises a surfactant, a co-solvent selected from the group consisting of polypropylene glycol, polyethylene glycol, and derivatives and mixtures thereof, and a foam stabilizer; and (b) the decontamination formulation comprises a chloroisocyanuric acid, and a buffer to maintain said formulation at a pH from about 11 to about 8.5.

19. The system of claim 18 wherein the foam formulation comprises:

(a) about 0.4–4 weight % of the surfactant; about 0.03–0.5 weight % of the foam stabilizer; and about 0.10–9.5 weight % of the co-solvent;

(b) about 3–6% of the chloroisocyanuric acid; and (c) the balance being water.

20. The system of claim 18 wherein the foam formulation comprises:

(a) about 3% by weight of a chloroisocyanuric acid;

(b) about 0.6 weight % of the surfactant;

(c) about 0.03 weight % of the foam stabilizer;

(d) and about 0.75% of the solvent selected from the group consisting of polypropylene glycol, polyethylene glycol, and derivatives and mixtures thereof;

(e) a buffer to maintain said formulation at a pH from about 11 to about 8.5; and (f) the balance being water.

* * * * *